US011031168B2

(12) United States Patent
Nagano et al.

(10) Patent No.: US 11,031,168 B2
(45) Date of Patent: Jun. 8, 2021

(54) LAMINATED COIL COMPONENT

(71) Applicant: TAIYO YUDEN CO., LTD., Tokyo (JP)

(72) Inventors: Masanori Nagano, Tokyo (JP); Hidekazu Teshigawara, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 189 days.

(21) Appl. No.: 16/141,056

(22) Filed: Sep. 25, 2018

(65) Prior Publication Data

US 2019/0103209 A1 Apr. 4, 2019

(30) Foreign Application Priority Data

Sep. 29, 2017 (JP) ..... JP2017-190553

(51) Int. Cl.

| | |
|---|---|
| ***H01F 17/00*** | (2006.01) |
| ***H01F 1/20*** | (2006.01) |
| ***H01F 27/29*** | (2006.01) |
| ***H01F 17/04*** | (2006.01) |
| ***H01F 27/255*** | (2006.01) |
| ***H01F 41/04*** | (2006.01) |
| ***H01F 27/28*** | (2006.01) |

(52) U.S. Cl.

CPC ..... *H01F 17/0013* (2013.01); *H01F 1/20* (2013.01); *H01F 17/04* (2013.01); *H01F 27/255* (2013.01); *H01F 27/2804* (2013.01); *H01F 27/29* (2013.01); *H01F 27/292* (2013.01); *H01F 41/046* (2013.01); *H01F 2017/048* (2013.01); *H01F 2027/2809* (2013.01)

(58) Field of Classification Search

CPC ..... H01F 17/0013; H01F 1/20

See application file for complete search history.

(56) References Cited

U.S. PATENT DOCUMENTS 6,169,470 B1 * 1/2001 Ibata ..... H01F 17/0006 336/83

2015/0340151 A1 * 11/2015 Yosui ..... H05K 1/0281 336/200

(Continued)

FOREIGN PATENT DOCUMENTS

| | | | |
|---|---|---|---|
| JP | 10-199729 A | | 7/1998 |
| JP | 10199729 A | * | 7/1998 |
| JP | 2000315617 A | * | 11/2000 |

*Primary Examiner* — Elvin G Enad
*Assistant Examiner* — Malcolm Barnes
(74) *Attorney, Agent, or Firm* — Pillsbury Winthrop Shaw Pittman, LLP

(57) ABSTRACT

To provide a new type of laminated coil component capable of providing a high inductance and excellent in insulation reliability. A laminated coil component according to one embodiment of the present invention is provided with a laminate, a first external electrode provided on a surface of the laminate, a second external electrode provided on a surface of the laminate, and a coil conductor provided between the first external electrode and the second external electrode. In the coil conductor, a conductor pattern having a larger potential difference from the second external electrode is arranged farther from the second external electrode, and a conductor pattern having a larger potential difference from the first external electrode is arranged farther from the first external electrode.

10 Claims, 11 Drawing Sheets

(56) References Cited

U.S. PATENT DOCUMENTS

2016/0005526 A1* 1/2016 Im ..... H01F 41/041
174/260
2016/0126003 A1* 5/2016 Lim ..... H01F 17/0013
336/200
2018/0308617 A1* 10/2018 Ha ..... H01F 27/24

* cited by examiner

LAMINATED COIL COMPONENT

CROSS-REFERENCE TO RELATED APPLICATIONS

This application is based on and claims the benefit of priority from Japanese Patent Application Serial No. 2017-190553 (filed on Sep. 29, 2017), the contents of which are hereby incorporated by reference in their entirety.

TECHNICAL FIELD

The present invention relates to a laminated coil component used in an electronic circuit. More specifically, the present invention relates to an improvement in inductance in a laminated coil component.

BACKGROUND

There is conventionally known a laminated coil component provided with a laminate including a plurality of insulating layers stacked together and a coil conductor embedded in the laminate. One example of such a laminated coil component is a laminated inductor. The laminated inductor is a passive element used in an electric circuit. For example, the laminated inductor is used to eliminate noise in a power source line or a signal line.

The laminate of the laminated coil component is fabricated by stacking a plurality of green sheets together and firing the thus stacked green sheets. The green sheets are made of a magnetic material such as ferrite. The plurality of green sheets each have a corresponding conductor pattern formed thereon before they are stacked together. The coil conductor is formed by stacking together green sheets each having a conductor pattern formed thereon and electrically connecting, by way of a via, the conductor pattern formed on each of the green sheets to another one of the green sheets.

There has been a demand that such a laminated coil component be reduced in size. When reduced in size, the laminated coil component is likely to have a reduced core area. A size reduction of the laminated coil component, therefore, might lead to a decrease in inductance.

In a case where the laminated coil component is used in a high-frequency circuit, there is also a demand for an improvement in frequency characteristics. Frequency characteristics of the laminated coil component can be improved by decreasing a stray capacitance between the coil conductor and an external conductor.

Japanese Patent Application Publication No. Hei 10-199729 ("the '729 Publication") discloses a laminated coil component for achieving a high inductance and excellent frequency characteristics. In the laminated coil component of the '729 Publication, a coil conductor is formed so that a coil axis is inclined with respect to a lamination direction of a laminate. According to the laminated coil component, a stray capacitance between an external electrode and the coil conductor can be decreased. Such a decrease in stray capacitance can be achieved without requiring a size reduction of the coil conductor, and thus according to the laminated coil component of the '729 Publication, it is also possible to prevent a decrease in inductance resulting from a reduction in core area.

It is demanded that an inductance in the laminated coil component be further improved. In the coil conductor of the laminated coil component of the above '729 Publication, since the coil axis is inclined with respect to the lamination direction of the laminate, a magnetic flux excited by the laminated coil component has to pass through a core of the laminated coil component along the inclined coil axis. Consequently, in the laminated coil component of the '729 Publication, compared with a coil conductor formed so that a coil axis is parallel to a lamination direction of a laminate, a length of a path through which an excited magnetic flux passes (a magnetic path length) is increased. In the laminated coil component, such an increase in magnetic path length might lead to a degradation in inductance.

In order to obtain a high magnetic permeability, as an insulating material for each of the insulating layers of the laminate, a composite resin material including metal particles of a soft magnetic material has been used in place of ferrite. Such an insulating layer made of a composite resin material including metal particles has an insulation property lower than that of ferrite, and thus there is a fear that insulation between the coil conductor and an external electrode might not be ensured. It is, therefore, desired that insulation reliability between the coil conductor and the external electrode be improved.

SUMMARY

One object of the present invention is to provide a new type of laminated coil component capable of providing a high inductance and excellent in insulation reliability. Other objects of the present invention will be made apparent through description of the specification as a whole.

A laminated coil component according to one embodiment of the present invention is provided with a laminate, a first external electrode provided on a surface of the laminate, a second external electrode provided on a surface of the laminate, and a coil conductor having a plurality of conductor patterns. The laminate includes a plurality of insulating layers stacked in a predetermined direction. The coil conductor is formed so that a coil axis thereof agrees with a lamination direction of the plurality of insulating layers.

The above-described coil conductor is provided between the first external electrode and the second external electrode. The plurality of conductor patterns constituting the above-described coil conductor includes a conductor pattern (a1) in a first turn as counted from the first external electrode and a conductor pattern (aN) in an N-th turn as counted from the first external electrode. The conductor pattern (a1) may have one end thereof connected to a first lead-out conductor and be connected to the above-described first external electrode via the first lead-out conductor. The conductor pattern (aN) may have one end thereof connected to a second lead-out conductor and be connected to the above-described second external electrode via the second lead-out conductor. The above-described plurality of conductor patterns may further include a conductor pattern (am) on an m-th turn as counted from the first external electrode. The conductor pattern (am) has one end thereof connected to the above-described conductor pattern (a1) and the other end thereof connected to the above-described conductor pattern (aN).

In one embodiment of the present invention, the above-described coil conductor is configured so that a distance d(m) between the conductor pattern (am), among the plurality of conductor patterns, in the m-th turn (where m is any integer satisfying $2 \leq m \leq N$) as counted from the first external electrode and the second external electrode satisfies a relationship $d(1) \times (N-m+1)/N \leq d(m) \leq d(1)$ (where when m has a certain value, d(m) and d(1) have different values from each other).

In the above-described coil component, in a case where an electric current flows from the first external electrode toward the second external electrode, the electric current flows from the first external electrode to the above-described second external electrode by passing through the conductor pattern (a1), the conductor pattern (am), and the conductor pattern (aN) in this order. In this electric current path, since the conductor pattern (a1) is arranged more closely to the first external electrode than the conductor pattern (am), a potential difference between the conductor pattern (a1) and the second external electrode is larger than a potential difference between the conductor pattern (am) and the second external electrode. According to the above-described embodiment, since the relationship $d(1)\times(N-m+1)/N\leq d(m)\leq d(1)$ (where when m has a certain value, d(m) and d(1) have different values from each other) is satisfied, the conductor pattern (a1) having the largest potential difference from the above-described second external electrode is arranged farthest from the above-described second external electrode. For example, in a case where N=2, it follows that m=2, and thus the above inequality is expressed as $d(1)\times\frac{1}{2}\leq d(2)\leq d(1)$. Further, it is required that when m=2, d(2) and d(1) have different values from each other, and with this condition also taken into consideration, the above inequality is expressed as $d(1)\times\frac{1}{2}\leq d(2)\leq d(1)$. Consequently, the conductor pattern (a1) in the first turn as counted from the first external electrode is arranged farther from the second electrode than a conductor pattern (a2) in a second turn as counted from the first external electrode. Also in a case where N>3, similarly, the larger a potential difference a conductor pattern has from the second external electrode, the farther the conductor pattern is arranged from the above-described second external electrode. For example, in a case where N =3, the above inequality is expressed as $d(1)\times(4-m)/3\leq d(m)\leq d(1)$. Therefore, in a case where m=2, an inequality $d(1)\times\frac{2}{3}\leq d(2)\leq d(1)$ is established, and in a case where m=3, an inequality $d(1)\times\frac{1}{3}\leq d(3)\leq d(1)$ is established. When consideration is given to the condition that when m has a certain value, d(m) and d(1) have different values from each other, in a case where d(1)=d(2), it follows that $d(3)\neq d(1)$, and thus an inequality $d(3)<d(1)$ is established. In a case where d(1)=d(3), it follows that $d(2)\neq d(1)$, and thus an inequality $d(2)<d(1)$ is established. Therefore, a magnitude relationship among d(1), d(2), and d(3) in a case where N=3 is summarized as $d(3)<d(2)\leq d(1)$ or $d(2)<d(3)\leq d(1)$. As thus described, a distance between the conductor pattern (a1) having a large potential difference from the second external electrode and the second external electrode is set to be large, and thus an insulation property between the above-described coil conductor and the above-described second external electrode is ensured.

In one embodiment of the present invention, the above-described coil conductor is configured so that a distance D(n) between a conductor pattern (bn), among the plurality of conductor patterns, in an n-th turn (where n is any integer satisfying $2\leq n\leq N$) as counted from the second external electrode and the first external electrode satisfies a relationship $D(1)\times(N-m+1)/N\leq D(n)\leq D(1)$ (where when n has a certain value, D(n) and D(1) have different values from each other).

In the above-described coil component, in a case where an electric current flows from the second external electrode toward the first external electrode, the electric current flows from the above-described second external electrode to the above-described first external electrode by passing through a conductor pattern (b1), the conductor pattern (bn), and a conductor pattern (bN) in this order. In this electric current path, since the conductor pattern (b1) is arranged more closely to the second external electrode than the conductor pattern (bn), a potential difference between the conductor pattern (b1) and the first external electrode is larger than a potential difference between the conductor pattern (bn) and the first external electrode. According to the above-described embodiment, since the relationship $D(1)\times(N-m+1)/N\leq D(n)\leq D(1)$ (where when n has a certain value, D(n) and D(1) have different values from each other) is satisfied, the conductor pattern (b1) having the largest potential difference from the above-described first external electrode is arranged farthest from the above-described first external electrode. A magnitude relationship between D(1) and D(2) in a case where N=2 can be considered pursuant to the already described relationship between d(1) and d(2). A magnitude relationship among D(1), D(2), and D(3) in a case where N=3 can be considered pursuant to the already described relationship among d(1), d(2), and d(3). As thus described, a distance between the conductor pattern (b1) having a large potential difference from the first external electrode and the second external electrode is set to be large, and thus an insulation property between the above-described coil conductor and the above-described second external electrode is ensured.

In one embodiment of the present invention, when viewed from a direction of the coil axis, an inner periphery of each of the plurality of conductor patterns constituting the coil conductor extends along at least part of a closed loop surrounding the coil axis. Thus, a plane including the inner periphery of each of the plurality of conductor patterns extends parallel to a lamination direction in which the plurality of insulating layers are stacked. Therefore, a magnetic flux passing through a core defined by the inner peripheral surface of each of the plurality of conductor patterns is directed parallel to the lamination direction of the plurality of insulating layers. This can prevent a degradation in inductance due to a direction of a magnetic flux passing through the core being inclined with respect to the coil axis.

On the closed loop, there are a first position closest to the first external electrode and a second position closest to the second external electrode. As described above, the coil conductor is formed so that a distance between the conductor pattern (a1) and the second external electrode is larger than a distance between any other one (a conductor pattern (am)) of the plurality of conductor patterns and the second external electrode. Such a relationship is achieved by, for example, a technique in which, at the above-described second position, with the inner periphery of the above-described conductor pattern (a1) secured on the above-described closed loop, a dimension of the above-described conductor pattern (a1) in a width direction is reduced. In this case, at the second position, a direct current resistance (Rdc) of the conductor pattern (a1) is disadvantageously increased. As a solution to this, in one embodiment of the present invention, the conductor pattern (a1) is formed so that a cross-sectional area thereof at the above-described first position is equal to that at the above-described second position. Thus, the conductor pattern (a1) can be set so that a direct current resistance thereof at the first position is equal to that at the second position.

ADVANTAGES

According to the above-described embodiment, there is provided a laminated coil component capable of providing a high inductance and excellent in insulation reliability.

DESCRIPTION OF THE PREFERRED EMBODIMENTS

By appropriately referring to the appended drawings, the following describes various embodiments of the present invention. Constituent elements common to a plurality of drawings are denoted by the same reference signs throughout the plurality of drawings. It should be noted that the drawings do not necessarily appear to an accurate scale for the sake of convenience of description.

Figure 1:
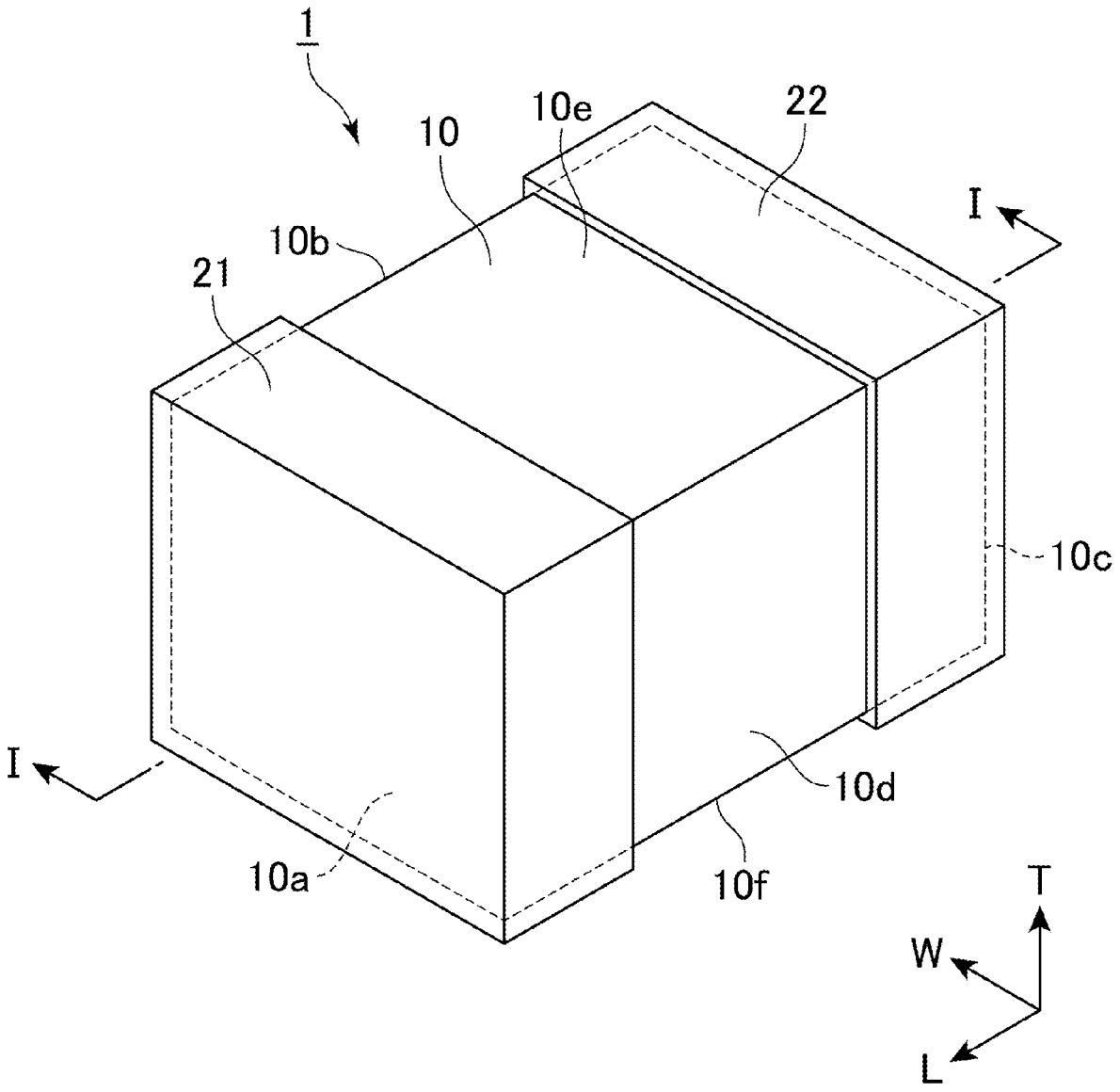
FIG. 1 is a perspective view of a laminated coil component according to one embodiment of the present invention.
Figure 2:
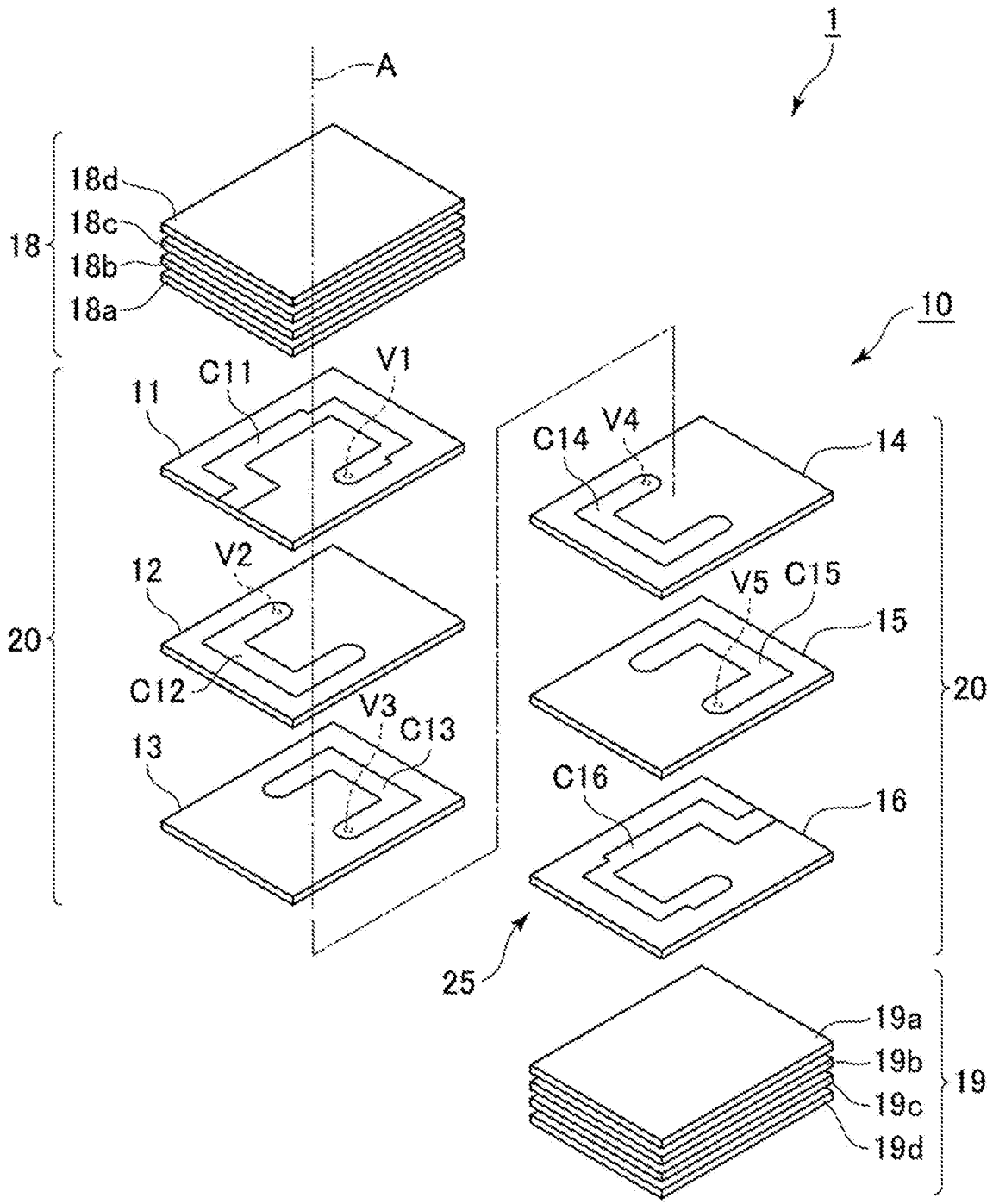
FIG. 2 is an exploded perspective view of the laminated coil component in FIG. 1.

FIG. 1 is a perspective view of a coil component 1 according to one embodiment of the present invention, and FIG. 2 is an exploded perspective view of the coil component 1 shown in FIG. 1.

Each of these figures shows, as one example of the coil component 1, a laminated inductor used as a passive element in various types of circuits. The laminated inductor is one example of a laminated coil component to which the present invention is applicable. The present invention can be applied to a power inductor incorporated into a power source line and other various types of laminated coil components.

The coil component 1 in the embodiment shown is provided with a laminate 10 including insulating layers stacked together, the insulating layers being made of a magnetic material, conductor patterns C11 to C16 embedded in the laminate 10, an external electrode 21 electrically connected to one end of the conductor pattern C11, and an external electrode 22 electrically connected to one end of the conductor pattern C16. The conductor patterns C11 to C16 are each electrically connected to an adjacent one of the conductor patterns C11 to C16 via after-mentioned vias V1 to V5, and the conductor patterns C11 to C16 connected together in this manner constitute a coil conductor 25. The conductor pattern C11 is connected to the external electrode 21 via an after-mentioned lead-out conductor 23, and the conductor pattern C16 is connected to the external electrode 22 via an after-mentioned lead-out conductor 24.

As shown in the figures, in one embodiment of the present invention, the laminate 10 is formed in a substantially rectangular parallelepiped shape. The laminate 10 has a first principal surface 10*e*, a second principal surface 10*f*, a first end surface 10*a*, a second end surface 10*c*, a first side surface 10*b*, and a second side surface 10*d*. Outer surfaces of the laminate 10 are defined by these six surfaces. The first principal surface 10*e* and the second principal surface 10*f* are opposed to each other, the first end surface 10*a* and the second end surface 10*c* are opposed to each other, and the first side surface 10*b* and the second side surface 10*d* are opposed to each other. In a case where the laminate 10 is formed in a rectangular parallelepiped shape, the first principal surface 10*e* and the second principal surface 10*f* are parallel to each other, the first end surface 10*a* and the second end surface 10*c* are parallel to each other, and the first side surface 10*b* and the second side surface 10*d* are parallel to each other.

In the embodiment of FIG. 1, the first principal surface 10*e* lies on a top side of the laminate 10 and, therefore, may be referred to as a "top surface" in this specification. Similarly, the second principal surface 10*f* may be referred to as a "bottom surface." In the coil component 1, the second principal surface 10*f* is disposed so as to be opposed to a circuit board (not shown) and, therefore, may be referred to as a "mounting surface" in this specification. Furthermore, a top-bottom direction of the coil component 1 is based on a top-bottom direction in FIG. 1.

In this specification, a "length" direction, a "width" direction, and a "thickness" direction of the coil component 1 are referred to as an "L" axis direction, a "W" axis direction, and a "T" axis direction in FIG. 1, respectively, unless otherwise construed from the context.

In one embodiment of the present invention, the coil component 1 has a length (a dimension in the L axis direction) of 0.2 to 6.0 mm, a width (a dimension in the W axis direction) of 0.1 to 4.5 mm, and a thickness (a dimension in the T axis direction) of 0.1 to 4.0 mm. These dimensions are mere examples, and the coil component 1 to which the present invention is applicable can have any dimensions that conform to the purport of the present invention. In one embodiment, the coil component 1 has a low profile. For example, the coil component 1 has a width larger than a thickness thereof.

FIG. 2 is an exploded perspective view of the coil component 1 in FIG. 1. In FIG. 2, for the sake of convenience of illustration, the external electrode 21 and the external electrode 22 are not shown. As shown in the figure, the laminate 10 includes an insulator portion 20, a top cover layer 18 provided on a top surface of the insulator portion 20, and a bottom cover layer 19 provided on a bottom surface of the insulator portion 20. The insulator portion 20 includes insulating layers 11 to 16 stacked together. The laminate 10 includes the top cover layer 18, the insulating layer 11, the insulating layer 12, the insulating layer 13, the insulating layer 14, the insulating layer 15, the insulating layer 16, the insulating layer 17, and the bottom cover layer 19 that are stacked in this order from top to bottom in FIG. 2.

The top cover layer 18 includes four insulating layers 18*a* to 18*d*. The top cover layer 18 includes the insulating layer 18*a*, the insulating layer 18*b*, the insulating layer 18*c*, and the insulating layer 18*d* that are stacked in this order from top to bottom in FIG. 2.

The bottom cover layer 19 includes four insulating layers 19*a* to 19*d*. The bottom cover layer 19 includes the insulating layer 19*a*, the insulating layer 19*b*, the insulating layer 19*c*, and the insulating layer 19*d* that are stacked in this order from top to bottom in FIG. 2.

As will be mentioned later, the insulating layers 11 to 16 have corresponding conductor patterns C11 to C16 formed thereon, respectively. The conductor patterns C11 to C16 and the lead-out conductors 23 and 24 constitute the coil conductor 25. This coil conductor 25 has a coil axis A. The conductor patterns C11 to C16 are formed to extend around the coil axis A. In the embodiment shown, the coil axis A extends in the T axis direction, and the insulating layers 11 to 16 are stacked also in the T axis direction. A direction of the coil axis A, therefore, agrees with a lamination direction of the insulating layers 11 to 16.

In another embodiment of the present invention, the insulating layers 11 to 16 may be stacked in the L axis direction. In this case, the conductor patterns C11 to C16 are formed on surfaces of the insulating layers 11 to 16, respectively, and thus the coil axis A is oriented in the L axis direction, i.e. the same direction as the lamination direction of the insulating layers 11 to 16. In still another embodiment of the present invention, the insulating layers 11 to 16 may be stacked in the W axis direction. In this case, the conductor patterns C11 to C16 are formed on the surfaces of the insulating layers 11 to 16, respectively, and thus the coil axis A is oriented in the W axis direction, i.e. the same direction as the lamination direction of the insulating layers 11 to 16.

A resin contained in the insulating layers 11 to 16, the insulating layers 18*a* to 18*d*, and the insulating layers 19*a* to 19*d* is made of an insulating material. In one embodiment, the insulating material is a resin material having an excellent insulation property. As the resin material, for example, there can be used a polyvinyl butyral (PVB) resin, an ethyl cellulose resin, a polyvinyl alcohol resin, or an acrylic resin. The resin contained in the insulating layers 11 to 16, the insulating layers 18*a* to 18*d*, and the insulating layers 19*a* to 19*d* may be a thermosetting resin having an excellent insulation property. As the thermosetting resin, for example, there can be used an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, or a polybenzoxazole (PBO) resin. The resin contained in each of the insulating layers and sheets may be a resin of the same type as in other insulating layers and sheets or a different type therefrom.

In a case where the insulating layers 11 to 16, the insulating layers 18*a* to 18*d*, and the insulating layers 19*a* to 19*d* are formed of such a resin material, these insulating layers may contain filler particles. The filler particles are, for example, particles of a ferrite material, soft magnetic metal particles, particles of an inorganic material such as $SiO_2$ or $Al_2O_3$, or glass-based particles. Particles of a ferrite material applicable to the present invention are, for example, particles of Ni—Zn ferrite or particles of Ni—Zn—Cu ferrite. Soft magnetic metal particles applicable to the present invention are made of a material in which magnetism is developed in an unoxidized metal portion, and such soft magnetic metal particles are, for example, particles including unoxidized metal particles or alloy particles. Soft magnetic metal particles applicable to the present invention include particles of, for example, an Fe—Si—Cr, Fe—Si—Al, or Fe—Ni alloy, an Fe—Si—Cr—B—C or Fe—Si—B—Cr amorphous alloy, Fe, or a material obtained by mixing them.

The insulating layers 11 to 16, the insulating layers 18*a* to 18*d*, and the insulating layers 19*a* to 19*d* may be formed by combining a multitude of soft magnetic metal particles whose surfaces are coated with an insulating film. The insulating film is, for example, an oxide film formed by oxidizing a surface of a soft magnetic metal. Such an insulating layer formed of a multitude of soft magnetic metal particles thus combined is not required to contain a resin. Soft magnetic metal particles applicable to the present invention include particles of, for example, an Fe—Si—Cr, Fe—Si—Al, or Fe—Ni alloy, an Fe—Si—Cr—B—C or Fe—Si—B—Cr amorphous alloy, Fe, or a material obtained by mixing them. For example, Japanese Patent Application Publication No. 2013-153119 discloses a structure formed of soft magnetic metal particles, which can be used as each of the insulating layers 11 to 16, the insulating layers 18*a* to 18*d*, and the insulating layers 19*a* to 19*d*.

The coil component 1 can include any number of insulating layers as necessary in addition to the insulating layers 11 to 16, the insulating layers 18*a* to 18*d*, and the insulating layers 19*a* to 19*d*. Some of the insulating layers 11 to 16, the insulating layers 18*a* to 18*d*, and the insulating layers 19*a* to 19*d* can be omitted as appropriate.

The conductor patterns C11 to C16 are each formed on a corresponding one of the insulating layers 11 to 16. The conductor patterns C11 to C16 are formed by printing such as screen printing, plating, etching, or any other known method. Respective shapes and arrangements of the conductor patterns C11 to C16 will be described later.

The insulating layers 11 to 15 each include a corresponding one of the vias V1 to V5 formed at a predetermined position thereon. The vias V1 to V5 are formed by forming through-holes at the predetermined positions on the insulating layers 11 to 15 so as to extend through the insulating layers 11 to 15 in the T axis direction, respectively, and filling a metal material into the through-holes.

The conductor patterns C11 to C16 and the vias V1 to V5 are formed to contain a metal having excellent electrical conductivity and thus are made of, for example, Ag, Pd, Cu, Al, or any alloy of these metals.

Specific materials described in this specification are illustrative, and other materials not illustratively described in this specification can also be used as materials of the constituent elements of the coil component 1 as appropriate.

In one embodiment, the external electrode 21 is provided on the first end surface 10*a* of the laminate 10, and the external electrode 22 is provided on the second end surface 10*c* of the laminate 10. As shown in the figure, the external electrode 21 and the external electrode 22 may extend further onto the top surface 10*e*, the bottom surface 10*f*, the first side surface 10*b*, and the second side surface 10*d* of the laminate 10. In this case, in the laminate 10, the external electrode 21 is provided so as to entirely cover the first end surface 10*a* and partly cover each of the top surface 10*e*, the bottom surface 10*f*, the first side surface 10*b*, and the second side surface 10*d*, and the external electrode 22 is provided so as to entirely cover the second end surface 10*c* and partly cover each of the top surface 10*e*, the bottom surface 10*f*, the first side surface 10*b*, and the second side surface 10*d*.

Figure 3A:
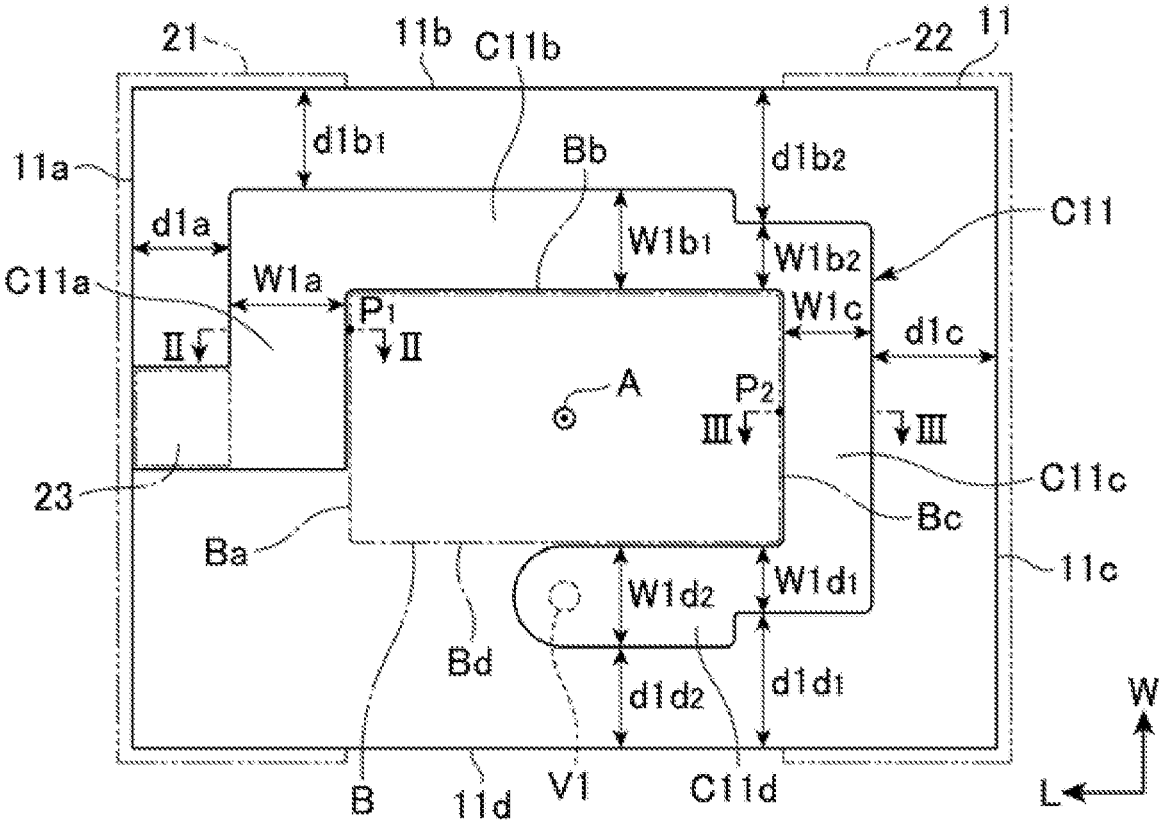
FIG. 3*a* is a plan view of an insulating layer 11 in FIG. 2.
Figure 3B:
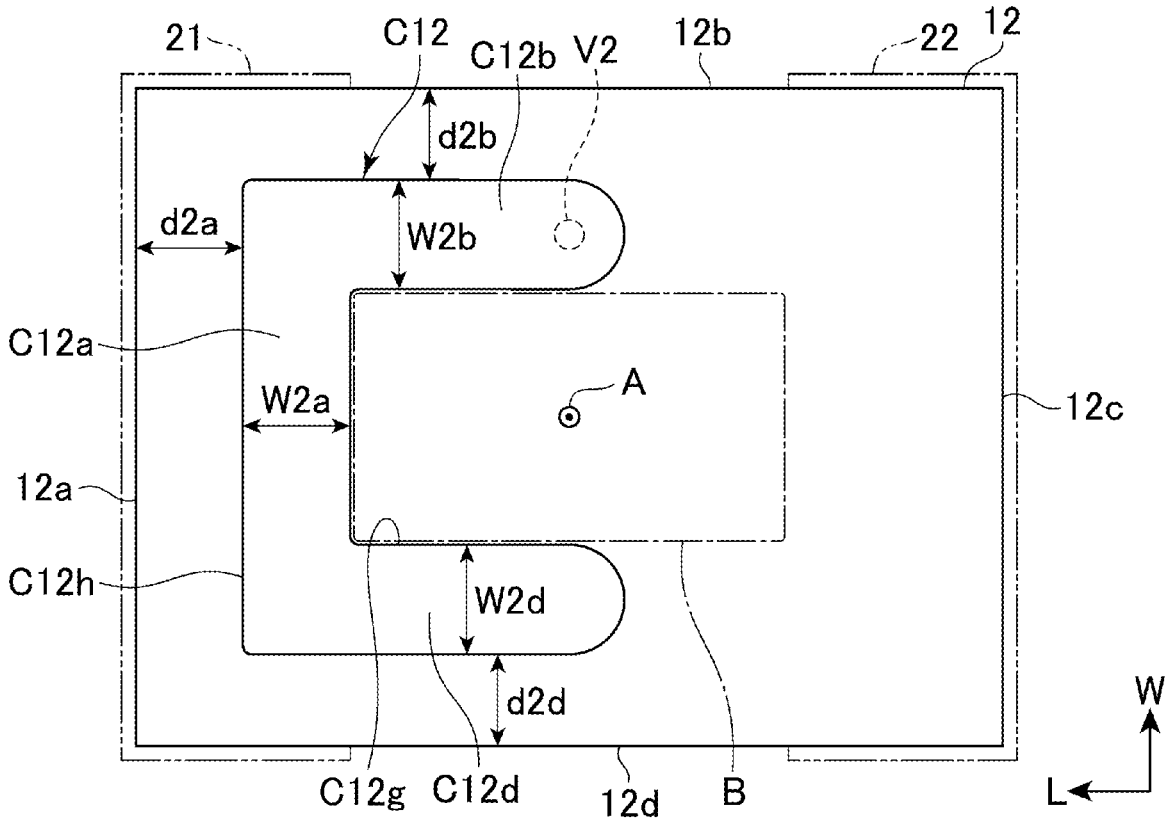
FIG. 3*b* is a plan view of an insulating layer 12 in FIG. 2.
Figure 3C:
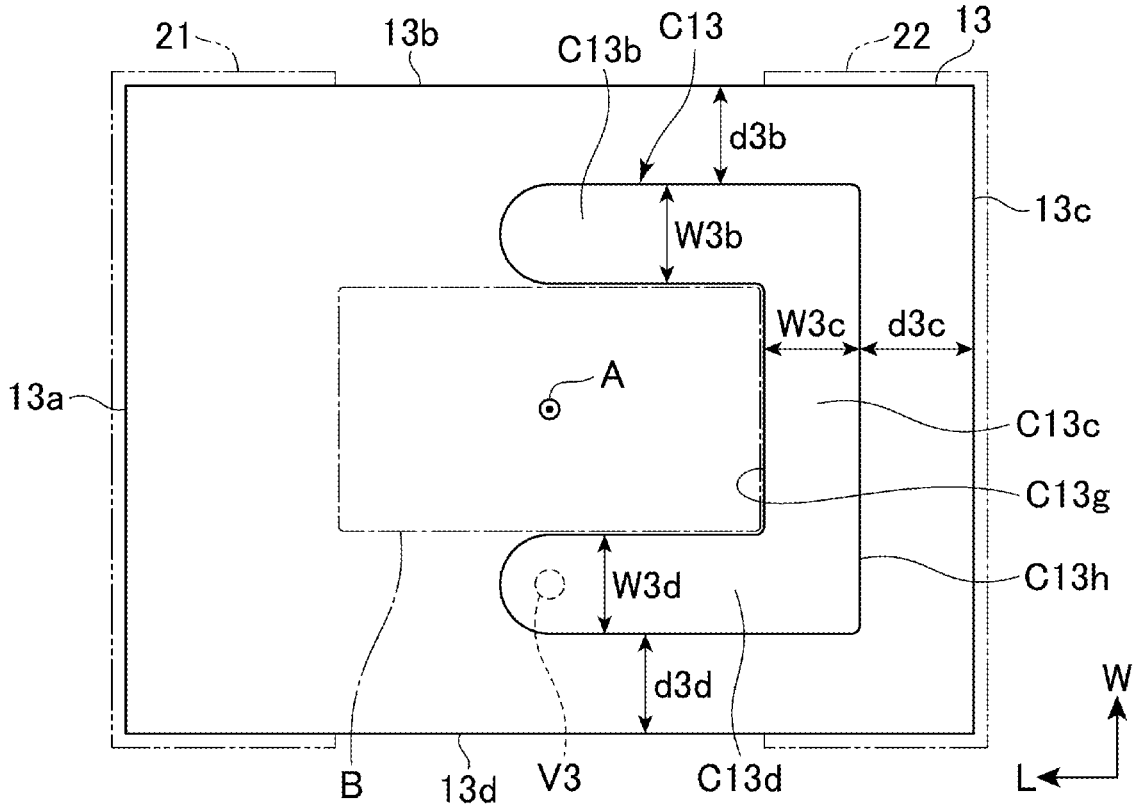
FIG. 3*c* is a plan view of an insulating layer 13 in FIG. 2.
Figure 3D:
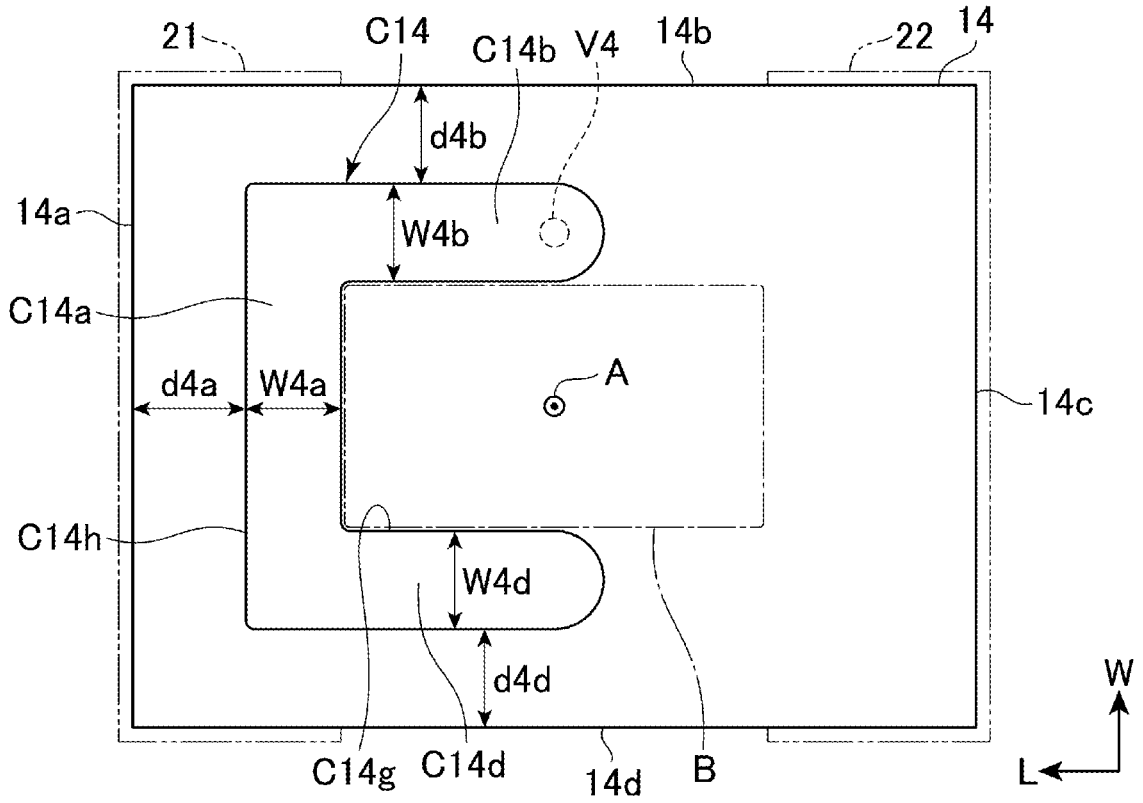
FIG. 3*d* is a plan view of an insulating layer 14 in FIG. 2.
Figure 3E:
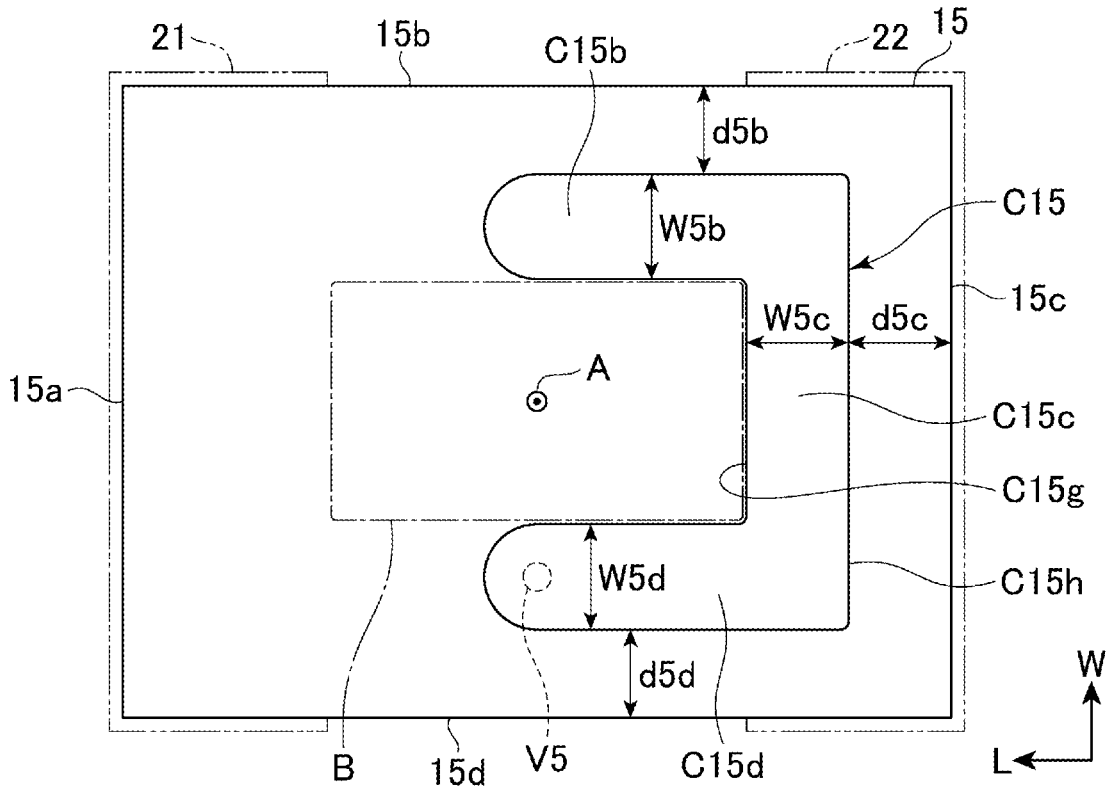
FIG. 3*e* is a plan view of an insulating layer 15 in FIG. 2.
Figure 3F:
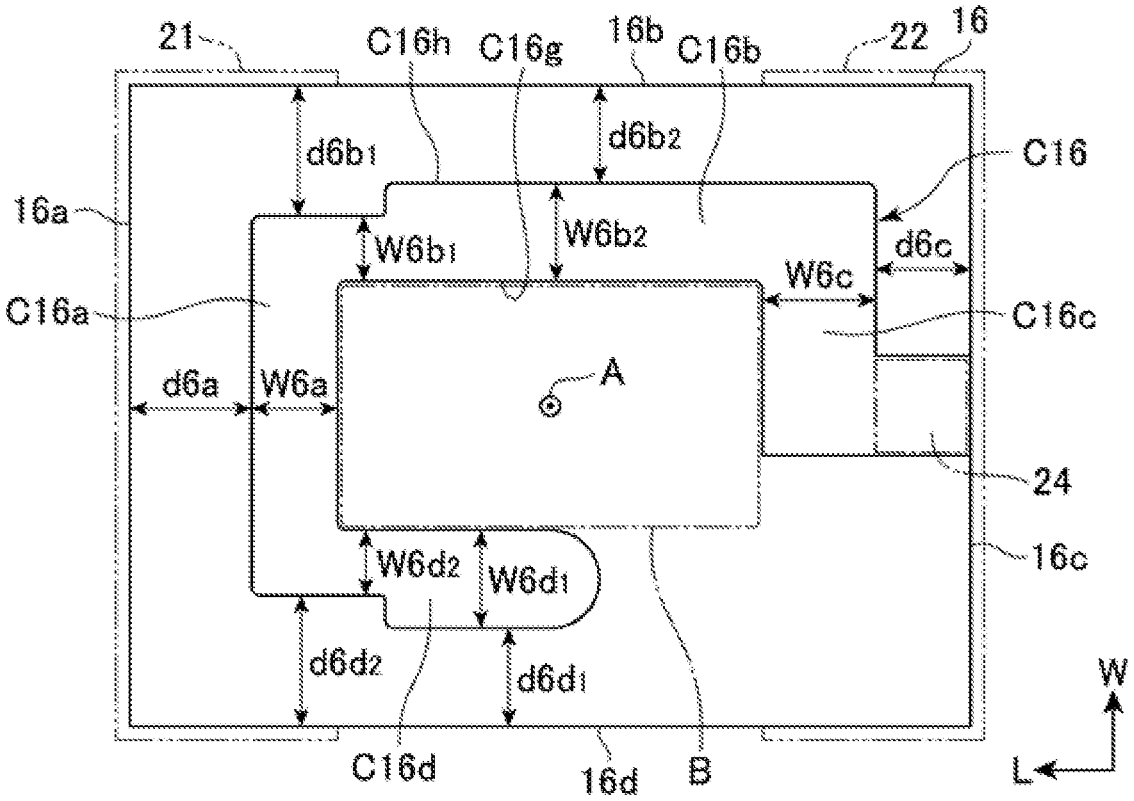
FIG. 3*f* is a plan view of an insulating layer 16 in FIG. 2.
Figure 4:
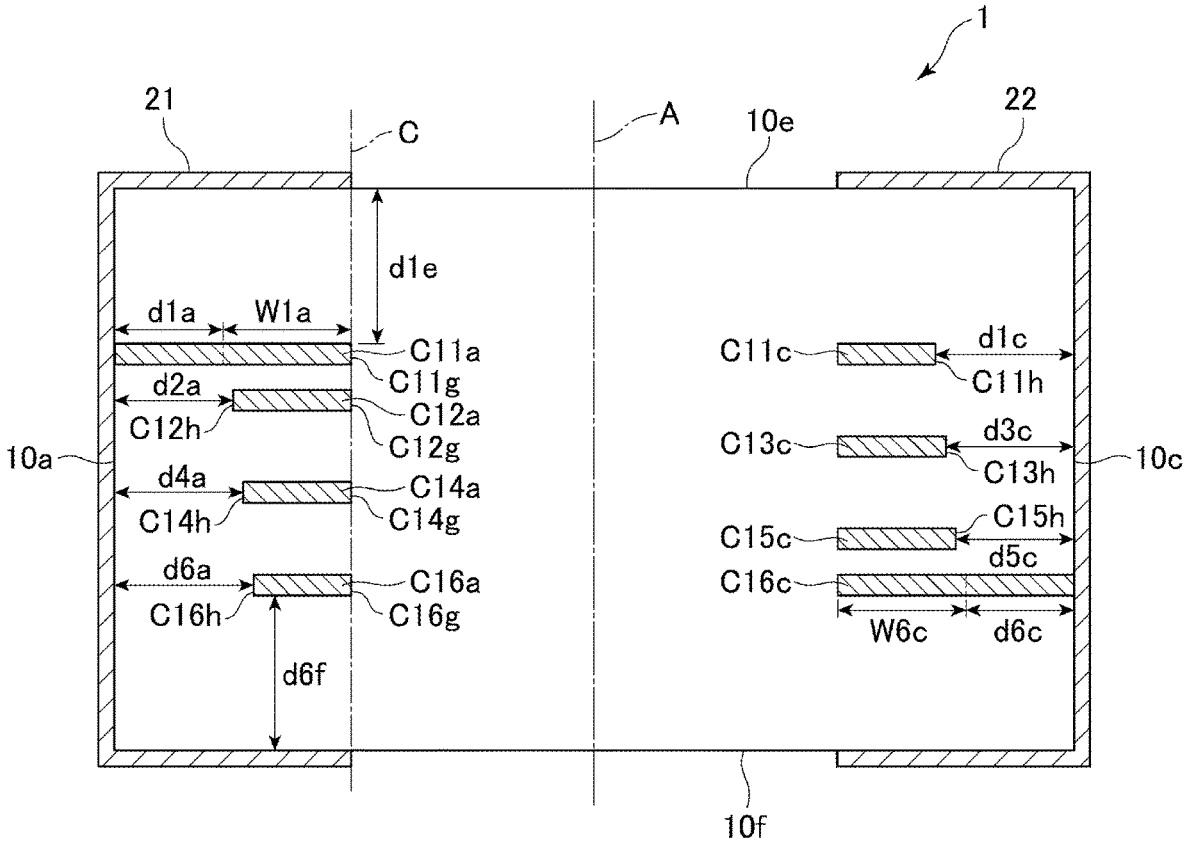
FIG. 4 is a view schematically showing a cross section of the coil component in FIG. 1 cut along a line I-I.

Next, with reference to FIG. 3*a* to FIG. 3*f* and FIG. 4, a further description is given of the coil component 1. FIG. 3*a* to FIG. 3*f* are plan views of the insulating layers 11 to 16, respectively. FIG. 3*a* to FIG. 3*f*, therefore, show the insulating layers 11 to 16, respectively, as viewed from the direction of the coil axis A. FIG. 4 is a view schematically showing a cross section of the coil component 1 cut along a line I-I in FIG. 1.

As shown in FIG. 3*a*, the conductor pattern C11 and the lead-out conductor 23 are formed on an upper surface of the insulating layer 11. The lead-out conductor 23 extends inwardly from a vicinity of a middle of a side 11*a* in the W axis direction. The lead-out conductor 23 is formed so as to be electrically in contact with the external electrode 21.

In one embodiment of the present invention, the conductor pattern C11 is formed to extend, from an end portion of the lead-out conductor 23, substantially ¾ of a turn in a clockwise direction along a closed loop B surrounding the coil axis A. The conductor pattern C11 extends from a 9 o'clock position to a 6 o'clock position in the clockwise direction along the closed loop B. The conductor pattern C11 has an inner peripheral surface C11*g* and an outer peripheral surface C11*h*. The conductor pattern C11 is formed so that, when viewed from the direction of the coil axis A, the inner peripheral surface C11*g* thereof extends along part of the closed loop B (part of a side Ba, an entire length of a side Bb, an entire length of a side Bc, and part of a side Bd).

In the embodiment shown, the closed loop B has a shape corresponding to sides of a rectangular through which the coil axis A extends. Specifically, the closed loop B includes the side Ba extending parallel to the side 11*a* of the insulating layer 11, the side Bb connected to one end of the side Ba and extending parallel to a side 11*b* of the insulating layer 11, the side Bc connected to one end of the side Bb and extending parallel to a side 11*c* of the insulating layer 11, and the side Bd connected to one end of the side Bc and extending parallel to a side 11*d* of the insulating layer 11. The closed loop B can assume various shapes in addition to a rectangular shape. The closed loop B can assume, for example, a shape corresponding to a circumference of a circle, a shape corresponding to a circumference of an ellipse, a shape corresponding to sides of a rectangle or any other type of polygon, or other various shapes.

In the embodiment shown, the conductor pattern C11 has a first portion C11*a* extending in a W axis positive direction from a right end of the lead-out conductor 23, a second portion C11*b* extending in an L axis negative direction from an upper end of the first portion C11*a*, a third portion C11*c* extending in a W axis negative direction from a right end of the second portion C11*b*, and a fourth portion C11*d* extending in an L axis positive direction from a lower end of the third portion C11*c*.

As shown in the figure, the first portion C11*a* of the conductor pattern C11 has a width W1*a* and is formed so that a spacing d1*a* is provided between an outer periphery thereof and the side 11*a*. Part of the external electrode 21 extends along the side 11*a*, and thus a spacing between the outer periphery of the first portion C11*a* and the external electrode 21 corresponds to the spacing d1*a*.

The second portion C11*b* has a wide portion connected to the first portion C11*a* and a narrow portion connected to the third portion C11*c*. The second portion C11*b* may be formed and disposed so that the wide portion is opposed to the external electrode 21 and the narrow portion is opposed to the external electrode 22. The wide portion of the second portion C11*b* has a width W1*b*1 and is formed so that a spacing d1*b*1 is provided between an outer periphery thereof and the side 11*b*. Part of the external electrode 21 extends along the side 11*b*, and thus a spacing between an outer periphery of the second portion C11*b* and the external electrode 21 corresponds to the spacing d1*b*1. The narrow portion of the second portion C11*b* has a width W1*b*2 and is formed so that a spacing d1*b*2 is provided between an outer periphery thereof and the side 11*b*. Part of the external electrode 22 extends along the side 11*b*, and thus a spacing between the outer periphery of the second portion C11*b* and the external electrode 22 corresponds to the spacing d1*b*2.

The third portion C11*c* has a width W1*c* and is formed so that a spacing d1*c* is provided between an outer periphery thereof and the side 11*c*. Part of the external electrode 22 extends along the side 11*c*, and thus a spacing between the outer periphery of the third portion C11*c* and the external electrode 22 corresponds to the spacing d1*c*.

The fourth portion C11*d* has a narrow portion connected to the third portion C11*c* and a wide portion extending in the L axis positive direction from an end portion of the narrow portion. The fourth portion C11*d* may be formed and disposed so that the wide portion is opposed to the external electrode 22. The narrow portion of the fourth portion C11*d* has a width W1*d*1 and is formed so that a spacing d1*d*1 is provided between an outer periphery thereof and the side 11*d*. The wide portion of the fourth portion C11*d* has a width W1*d*2 and is formed so that a spacing d1*d*2 is provided between an outer periphery thereof and the side 11*d*. Part of the external electrode 22 extends along the side 11*d*, and thus a spacing between an outer periphery of the fourth portion C11*d* and the external electrode 22 corresponds to the spacing d1*d*1.

In one embodiment of the present invention, the conductor pattern C11 is formed and disposed so that the spacing d1*c* between the outer periphery of the third portion C11*c* and the external electrode 22 is smaller than the spacing d1*b*2 between the outer periphery of the second portion C11*b* and the external electrode 22 and the spacing d1*d*1 between the outer periphery of the fourth portion C11*d* and the external electrode 22.

As shown in FIG. 4, the conductor pattern C11 is formed at a spacing die from the top surface 10*e* of the laminate 10. Part of the external electrode 22 extends along the top surface 10*e* of the laminate 10, and thus a spacing between the conductor pattern C11 and the external electrode 22 corresponds to the spacing die. In one embodiment of the present invention, the conductor pattern C11 is formed and disposed so that d1*c*<d1*e*.

A width of the conductor pattern C11 refers to a dimension of the conductor pattern C11 in a direction perpendicular to an extending direction of the conductor pattern C11 (a direction in which the conductor pattern C11 extends along the closed loop B). Widths of the other conductor patterns are also to be understood to have a similar meaning.

As shown in FIG. 3*b*, the conductor pattern C12 is formed on an upper surface of the insulating layer 12. The conductor pattern C12 is electrically connected to the conductor pattern C11 via the via V1.

The conductor pattern C12 is formed to extend, from a position where it is connected to the via V1, substantially ½ of a turn clockwise along the closed loop B. The conductor pattern C12 extends from a 6 o'clock position to a 12 o'clock position in the clockwise direction along the closed loop B.

The conductor pattern C12 has an inner peripheral surface C12*g* and an outer peripheral surface C12*h*. In an embodiment shown, the conductor pattern C12 is formed so that the inner peripheral surface C12*g* thereof extends along part of the closed loop B (part of the side Bd, an entire length of the side Ba, and part of the side Bb). Specifically, the conductor pattern C12 has a first portion C12*d* extending in the L axis positive direction from a connection position with the via V1, a second portion C12*a* extending in the W axis positive direction from a left end of the first portion C12*d*, and a third portion C12*b* extending in the L axis negative direction from an upper portion of the second portion C12*a*.

The first portion C12*d* of the conductor pattern C12 has a width W2*d* and is formed so that a spacing d2*d* is provided between an outer periphery thereof and a side 12*d*. The second portion C12*a* has a width W2*a* and is formed so that a spacing d2*a* is provided between an outer periphery thereof and a side 12*a*. The third portion C12*b* has a width W2*b* and is formed so that a spacing d2*b* is provided between an outer periphery thereof and a side 12*b*.

As shown in FIG. 3*c*, the conductor pattern C13 is formed on an upper surface of the insulating layer 13. The conductor pattern C13 is electrically connected to the conductor pattern C12 via the via V2. In an embodiment shown, the conductor pattern C13 is formed to extend, from a position where it is connected to the via V2, substantially ½ of a turn clockwise along the closed loop B. The conductor pattern C13 extends from a 12 o'clock position to a 6 o'clock position in the clockwise direction along the closed loop B.

The conductor pattern C13 has an inner peripheral surface C13*g* and an outer peripheral surface C13*h*. The conductor pattern C13 is formed so that the inner peripheral surface C13*g* thereof extends along part of the closed loop B (part of the side Bb, an entire length of the side Bc, and part of the side Bd). Specifically, the conductor pattern C13 has a first portion C13*b* extending in the L axis negative direction from a connection position with the via V2, a second portion C13*c* extending in the W axis negative direction from a right end of the first portion C13*b*, and a third portion C13*d* extending in the L axis positive direction from a lower end of the second portion C13*c*.

The first portion C13*b* of the conductor pattern C13 has a width W3*b* and is formed so that a spacing d3*b* is provided between an outer periphery thereof and a side 13*b*. The second portion C13*c* has a width W3*c* and is formed so that a spacing d3*c* is provided between an outer periphery thereof and a side 13*c*. The third portion C13*d* has a width W3*d* and is formed so that a spacing d3*d* is provided between an outer periphery thereof and a side 13*d*.

As shown in FIG. 3*d*, the conductor pattern C14 is formed on an upper surface of the insulating layer 14. The conductor pattern C14 is electrically connected to the conductor pattern C13 via the via V3. The conductor pattern C14 is formed in substantially the same shape as that of the conductor pattern C12. In an embodiment shown, the conductor pattern C14 is formed to extend, from a position where it is connected to the via V3, substantially ½ of a turn clockwise along the closed loop B. The conductor pattern C14 extends from a 6 o'clock position to a 12 o'clock position in the clockwise direction along the closed loop B.

The conductor pattern C14 has an inner peripheral surface C14*g* and an outer peripheral surface C14*h*. The conductor pattern C14 is formed so that the inner peripheral surface C14*g* thereof extends along part of the closed loop B (part of the side Bd, the entire length of the side Ba, and part of the side Bb). Specifically, the conductor pattern C14 has a first portion C14*d* extending in the L axis positive direction from a connection position with the via V3, a second portion C14*a* extending in the W axis positive direction from a left end of the first portion C14*d*, and a third portion C14*b* extending in the L axis negative direction from an upper end of the second portion C14*a*.

The first portion C14*d* of the conductor pattern C14 has a width W4*d* and is formed so that a spacing d4*d* is provided between an outer periphery thereof and a side 14*d*. The second portion C14*a* has a width W4*a* and is formed so that a spacing d4*a* is provided between an outer periphery thereof and a side 14*a*. The third portion C14*b* has a width W4*b* and is formed so that a spacing d4*b* is provided between an outer periphery thereof and a side 14*b*.

As shown in FIG. 3*e*, the conductor pattern C15 is formed on an upper surface of the insulating layer 15. The conductor pattern C15 is electrically connected to the conductor pattern C14 via the via V4. In an embodiment shown, the conductor pattern C15 is formed to extend, from a position where it is connected to the via V4, substantially ½ of a turn clockwise along the closed loop B. The conductor pattern C15 extends from a 12 o'clock position to a 6 o'clock position in the clockwise direction along the closed loop B.

The conductor pattern C15 has an inner peripheral surface C15 *g* and an outer peripheral surface C15*h*. The conductor pattern C15 is formed so that the inner peripheral surface C15*g* thereof extends along part of the closed loop B (part of the side Bb, the entire length of the side Bc, and part of the side Bd). Specifically, the conductor pattern C15 has a first portion C15*b* extending in the L axis negative direction from a connection position with the via V4, a second portion C15*c* extending in the W axis negative direction from a right end of the first portion C15*b*, and a third portion C15*d* extending in the L axis positive direction from a lower end of the second portion C15*c*.

The first portion C15*b* of the conductor pattern C15 has a width W5*b* and is formed so that a spacing d5*b* is provided between an outer periphery thereof and a side 15*b*. The second portion C15*c* has a width W5*c* and is formed so that a spacing d5*c* is provided between an outer periphery thereof and a side 15*c*. The third portion C15*d* has a width W5*d* and is formed so that a spacing d5*d* is provided between an outer periphery thereof and a side 15*d*.

As shown in FIG. 3*f*, the conductor pattern C16 and the lead-out conductor 24 are formed on an upper surface of the insulating layer 16. The conductor pattern C16 is electrically connected to the conductor pattern C15 via the via V5. The lead-out conductor 24 extends inwardly from a vicinity of a middle of a side 16*c* in the W axis direction. The lead-out conductor 24 is formed so as to be electrically in contact with the external electrode 22.

In an embodiment shown, the conductor pattern C16 is formed to extend, from a position where it is connected to the via V5, substantially ¾ of a turn clockwise along the closed loop B. The conductor pattern C16 extends from a 6 o'clock position to a 3 o'clock position in the clockwise direction along the closed loop B. One end of the conductor pattern C16 is connected to an end portion of the lead-out conductor 24.

The conductor pattern C16 has an inner peripheral surface C16*g* and an outer peripheral surface C16*h*. The conductor pattern C16 is formed so that the inner peripheral surface C16*g* thereof extends along part of the closed loop B (part of the side Bd, the entire lengths of the side Ba and the side Bb, and part of the side Bc). Specifically, the conductor pattern C16 has a first portion C16*d* extending in the L axis positive direction from a connection position with the via V5, a second portion C16*a* extending in the W axis positive direction from a left end of the first portion C16*d*, a third portion C16*b* extending in the L axis negative direction from an upper end of the second portion C16*a*, and a fourth portion C16*c* extending in the W axis negative direction from a right end of the third portion C16*b*.

As shown in the figure, the first portion C16*d* of the conductor pattern C16 has a wide portion extending in the L axis positive direction from the connection position with the via V5 and a narrow portion extending from a left end of the wide portion to a connection position with the second portion C16*a*. The first portion C16*d* may be formed and disposed so that the narrow portion is opposed to the external electrode 21. The wide portion of the first portion C16*d* has a width W6*d*1 and is formed so that a spacing d6*d*1 is provided between an outer periphery thereof and a side 16*d*. The narrow portion of the first portion C16*d* has a width W6*d*2 and is formed so that a spacing d6*d*2 is provided between an outer periphery thereof and the side 16*d*. Part of the external electrode 21 extends along the side 16*d*, and thus a spacing between an outer periphery of the first portion C16*d* and the external electrode 21 corresponds to the spacing d6*d*2.

The second portion C16*a* has a width W6*a* and is formed so that a spacing d6*a* is provided between an outer periphery thereof and a side 16*a*. Part of the external electrode 21 extends along the side 16*a*, and thus a spacing between the outer periphery of the second portion C16*a* and the external electrode 21 corresponds to the spacing d6*a*.

The third portion C16*b* has a narrow portion extending in the L axis negative direction from the second portion C16*a* and a wide portion extending from a right end of the narrow portion to a connection position with the fourth portion C16*c*. The third portion C16*b* may be formed and disposed so that the narrow portion is opposed to the external electrode 21 and the wide portion is opposed to the external electrode 22. The narrow portion of the third portion C16*b* has a width W6*b*1 and is formed so that a spacing d6*b*1 is provided between an outer periphery thereof and a side 16*b*. Part of the external electrode 21 extends along the side 16*b*, and thus a spacing between an outer periphery of the third portion C16*b* and the external electrode 21 corresponds to the spacing d6*b*1. The wide portion of the third portion C16*b* has a width W6*b*2 and is formed so that a spacing d6*b*2 is provided between an outer periphery thereof and the side 16*b*. Part of the external electrode 22 extends along the side 16*b*, and thus a spacing between the outer periphery of the third portion C16*b* and the external electrode 22 corresponds to the spacing d6*b*2.

The fourth portion C16*c* has a width W6*c* and is formed so that a spacing d6*c* is provided between an outer periphery thereof and a side 16*c*. Part of the external electrode 22 extends along the side 16*c*, and thus a spacing between the outer periphery of the fourth portion C16*c* and the external electrode 22 corresponds to the spacing d6*c*.

In one embodiment of the present invention, the conductor pattern C16 is formed and disposed so that the spacing d6*a* between the outer periphery of the second portion C16*a* and the external electrode 21 is larger than the spacing d6*d*2 between the outer periphery of the first portion C16*d* and the external electrode 21 and the spacing d6*b*1 between the outer periphery of the third portion C16*b* and the external electrode 21.

As shown in FIG. 4, the conductor pattern C16 is formed at a spacing d6*f* from the bottom surface 10*f* of the laminate 10. Part of the external electrode 21 extends along the bottom surface 10*f* of the laminate 10, and thus a spacing between the conductor pattern C16 and the external electrode 21 corresponds to the spacing d6*f*. In one embodiment of the present invention, the conductor pattern C16 is formed and disposed so that d6*a*<d6*f*.

As mentioned above, in the embodiment shown, the coil conductor 25 is constituted of the conductor patterns C11 to C16. Each of the conductor patterns C11 and C16 is wound ¾ of a turn around the coil axis A, and each of the conductor patterns C12 to C15 is wound ½ of a turn around the coil axis A. The coil conductor 25 formed by joining the conductor patterns C11 to C16 together is, therefore, wound 3.5 turns around the coil axis A.

In the coil conductor 25, a conductor pattern in a first turn as counted from the external electrode 21 is constituted of the entire conductor pattern C11 and a portion of the conductor pattern C12 extending clockwise from a connection point with the via V1 to a position superimposed in plan view on a winding start position of the conductor pattern C11 (a position where the conductor pattern C11 is connected to the lead-out conductor 23). In the embodiment shown, the conductor pattern in the first turn as counted from the external electrode 21 is constituted of the entire conductor pattern C11 and a portion of the conductor pattern C12 extending 90° clockwise from the connection point with the via V1 (a portion of the conductor pattern C12 extending from a 6 o'clock position to a 9 o'clock position).

Similarly to the conductor pattern in the first turn, a conductor pattern in a second turn as counted from the external electrode 21 is constituted of a portion of the conductor pattern C12 extending clockwise from a connection point with the conductor pattern in the first turn to the via V2, the entire conductor pattern C13, and a portion of the conductor pattern C14 extending clockwise from a connection point with the via V3 to a position superimposed in plan view on the winding start position of the conductor pattern C11. In the embodiment shown, the conductor pattern in the second turn as counted from the external electrode 21 is constituted of a portion of the conductor pattern C12 extending 90° clockwise from the connection point with the conductor pattern in the first turn (a portion of the conductor pattern C12 extending from a 9 o'clock position to a 12 o'clock position), the entire conductor pattern C13, and a portion of the conductor pattern C14 extending 90° clockwise from the connection point with the via V3 (a portion of the conductor pattern C14 extending from a 6 o'clock position to a 9 o'clock position). Similarly, a conductor pattern in a third turn as counted from the external electrode 21 is constituted of a portion of the conductor pattern C14 extending from a connection point with the conductor pattern in the second turn to the via V4, the entire conductor pattern C15, and a portion of the conductor pattern C16 extending from a connection point with the via V5 to a position superimposed in plan view on the winding start position of the conductor pattern C11. In the embodiment shown, the conductor pattern in the third turn as counted from the external electrode 21 is constituted of a portion of the conductor pattern C14 extending 90° clockwise from the connection point with the conductor pattern in the second turn (a portion of the conductor pattern C14 extending from a 9 o'clock position to a 12 o'clock position), the entire conductor pattern C15, and a portion of the conductor pattern C16 extending 90° clockwise from the connection point with the via V5 (a portion of the conductor pattern C16 extending from a 6 o'clock position to a 9 o'clock position). Lastly, a conductor pattern in a fourth turn as counted from the external electrode 21 is constituted of a portion of the conductor pattern C16 extending clockwise from a connection point with the conductor pattern in the third turn to a connection position with the lead-out conductor 24. In the embodiment shown, the conductor pattern in the fourth turn as counted from the external electrode 21 is constituted of a portion of the conductor pattern C16 extending 90° clockwise from the connection point with the conductor pattern in the third turn (a portion of the conductor pattern C16 extending from a 9 o'clock position to a 3 o'clock position). As thus described, the conductor pattern in the fourth turn as counted from the external electrode 21 is formed of a conductor pattern in the coil conductor 25, which extends from the connection point with the conductor pattern in the third turn to a position where the coil conductor 25 is wound 0.5 turns from that connection point. That is, in the embodiment shown, the conductor pattern in the fourth turn is constituted of a conductor pattern of less than one turn. The conductor pattern in the fourth turn may be constituted of a conductor pattern of exactly one turn or a conductor pattern of less than one turn.

In this specification, the conductor pattern in the first turn as counted from the external electrode 21 may be referred to as a conductor pattern (a1). Furthermore, more generally, a conductor pattern in an m-th turn as counted from the external electrode 21 may be referred to as a conductor pattern (am). In this case, m is any positive integer. In a case where the conductor pattern (am) is assumed to exclude the conductor pattern in the first turn, m is a positive integer equal to or higher than two. An upper limit of m is a maximum number of turns of the coil conductor 25. In the embodiment shown, the coil conductor 25 is wound 3.5 turns, and thus the maximum number of turns thereof is 4. Accordingly, the upper limit of m is also 4. When, however, reference is made to a conductor pattern (a(m+1)) in a subsequent turn following the conductor pattern (am), the upper limit of m is set to a number obtained by subtracting 1 from the maximum number of turns.

In the coil conductor 25, a conductor pattern in a first turn as counted from the external electrode 22 is constituted of the entire conductor pattern C16 and a portion of the conductor pattern C15 extending counterclockwise from a connection point with the via V5 to a position superimposed in plan view on a winding start position of the conductor pattern C16 (a position where the conductor pattern C16 is connected to the lead-out conductor 24). In the embodiment shown, the conductor pattern in the first turn as counted from the external electrode 22 is constituted of the entire conductor pattern C16 and a portion of the conductor pattern C15 extending 90° counterclockwise from the connection point with the via V5 (a portion of the conductor pattern C15 extending from a 6 o'clock position to a 3 o'clock position). Similarly, a conductor pattern in a second turn as counted from the external electrode 22 is constituted of a portion of the conductor pattern C15 extending counterclockwise from a connection point with the conductor pattern in the first turn to the via V4, the entire conductor pattern C14, and a portion of the conductor pattern C13 extending counterclockwise from a connection point with the via V3 to a position superimposed in plan view on the winding start position of the conductor pattern C16. In the embodiment shown, the conductor pattern in the second turn as counted from the external electrode 22 is constituted of a portion of the conductor pattern C15 extending 90° counterclockwise from the connection point with the conductor pattern in the first turn (a portion of the conductor pattern C15 extending from a 3 o'clock position to a 12 o'clock position), the entire conductor pattern C14, and a portion of the conductor pattern C13 extending 90° counterclockwise from the connection point with the via V3 (a portion of the conductor pattern C13 extending from a 6 o'clock position to a 3 o'clock position). Similarly, a conductor pattern in a third turn as counted from the external electrode 22 is constituted of a portion of the conductor pattern C13 extending counterclockwise from a connection point with the conductor pattern in the second turn to the via V2, the entire conductor pattern C12, and a portion of the conductor pattern C11 extending from a connection point with the via V1 to a position superimposed in plan view on the winding start position of the conductor pattern C16. In the embodiment shown, the conductor pattern in the third turn as counted from the external electrode 22 is constituted of a portion of the conductor pattern C13 extending 90° counterclockwise from the connection point with the conductor pattern in the second turn (a portion of the conductor pattern C13 extending from a 3 o'clock position to a 12 o'clock position), the entire conductor pattern C12, and a portion of the conductor pattern C11 extending 90° counterclockwise from the connection point with the via V1 (a portion of the conductor pattern C11 extending from a 6 o'clock position to a 3 o'clock position). Lastly, a conductor pattern in a fourth turn as counted from the external electrode 22 is constituted of a portion of the conductor pattern C11 extending counterclockwise from a connection point with the conductor pattern in the third turn to a connection position with the lead-out conductor 23. In the embodiment shown, the conductor pattern in the fourth turn as counted from the external electrode 22 is constituted of a portion of the conductor pattern C11 extending 90° counterclockwise from the connection point with the conductor pattern in the third turn (a portion of the conductor pattern C11 extending from a 3 o'clock position to a 9 o'clock position). As thus described, the conductor pattern in the fourth turn as counted from the external electrode 22 is formed of a conductor pattern in the coil conductor 25, which extends from the connection point with the conductor pattern in the third turn to a position where the coil conductor 25 is wound 0.5 turns from that connection point. That is, in the embodiment shown, the conductor pattern in the fourth turn is constituted of a conductor pattern of less than one turn. The conductor pattern in the fourth turn may be constituted of a conductor pattern of exactly one turn or a conductor pattern of less than one turn.

In this specification, the conductor pattern in the first turn as counted from the external electrode 22 may be referred to as a conductor pattern (b1). Furthermore, more generally, a conductor pattern in an n-th turn as counted from the external electrode 22 may be referred to as a conductor pattern (bn). In this case, n is any positive integer. In a case where the conductor pattern (bn) is assumed to exclude the conductor pattern in the first turn, n is a positive integer equal to or higher than two. An upper limit of n is a maximum number of turns of the coil conductor 25. In the embodiment shown, the coil conductor 25 is wound 3.5 turns, and thus the maximum number of turns thereof is 4. Accordingly, in this case, the upper limit of n is also 4. When, however, reference is made to a conductor pattern (b(n+1)) in a subsequent turn following the conductor pattern (bn), the upper limit of n is set to a number obtained by subtracting 1 from the maximum number of turns.

While the conductor patterns in the first turn, the second turn, and the third turn as counted from the external electrode 21 each extend one turn around the coil axis A, the conductor pattern in the fourth turn extends half a turn around the coil axis A. Similarly, while the conductor patterns in the first turn, the second turn, and the third turn as counted from the external electrode 22 each extend one turn around the coil axis A, the conductor pattern in the fourth turn extends half a turn around the coil axis A.

The coil conductor 25 in one embodiment of the present invention is configured so that, where a maximum number of turns of the coil conductor 25 is N, a distance d(m) between the conductor pattern (am) in the m-th turn as counted from the external electrode 21 and the second external electrode 22 satisfies a relationship $d(1)\times(N-m+1)/N \leq d(m) \leq d(1)$ (where when m has a certain value, d(m) and d(1) have different values from each other) (where $2 \leq m$). In this specification, a distance between a predetermined conductor pattern and the external electrode 22 refers to the smallest among spacings between the conductor pattern and the external electrode 22.

As described above, in the embodiment shown, the conductor pattern (a1) in the first turn as counted from the external electrode 21 has the entire conductor pattern C11 and the portion of the conductor pattern C12 extending 90° clockwise from the connection point with the via V1. In the embodiment shown, at least part of the conductor pattern C11 is arranged more closely to the external electrode 22 than the conductor pattern C12. Therefore, as a distance between the conductor pattern (a1) in the first turn and the external electrode 22, the smallest among the spacings d1*c*, d1*b*2, d1*d*1, and die between the various portions of the conductor pattern C11 and the external electrode 22 is used. The distance between the conductor pattern (a1) and the external electrode 22 is set so that an insulation property between the conductor pattern (a1) and the external electrode 22 is ensured.

In one embodiment of the present invention, as mentioned above, the conductor pattern C11 is formed and disposed so that the spacing d1*c* is the smallest among the spacings d1*c*, d1*b*2, d1*d*1, and die. In this case, the distance between the conductor pattern (a1) in the first turn and the external electrode 22 is equal to the spacing d1*c* between the third portion C11*c* and the external electrode 22.

In another embodiment of the present invention, the conductor pattern C11 can be formed and disposed so that, among the spacings d1*c*, d1*b*2, d1*d*1, and d1*e*, any one of them other than the spacing d1*c* is the smallest. For example, when the spacing d1*b*2 is the smallest among the spacings d1*c*, d1*b*2, d1*d*1 and d1*e*, the distance between the conductor pattern (a1) and the external electrode 22 corresponds to the spacing d1*b*2. When the spacing d1*d*1 is the smallest among them, the distance between the conductor pattern (a1) and the external electrode 22 corresponds to the spacing d1*d*1. When the spacing die is the smallest among them, the distance between the conductor pattern (a1) and the external electrode 22 corresponds to the spacing d1*e*.

A distance between each of the conductor patterns in the second and subsequent turns and the external electrode 22 is also defined similarly to the distance between the conductor pattern (a1) in the first turn and the external electrode 22. That is, a distance between the conductor pattern (am) in the m-th turn as counted from the external electrode 21 and the external electrode 22 refers to the smallest among the spacings between the conductor pattern (am) and the external electrode 22. The distance between the conductor pattern (am) and the external electrode 22 is set so that an insulation property between the conductor pattern (am) and the external electrode 22 is ensured.

In the embodiment shown, N=4 and d(1)=d1*c*, and thus the distance d(m) between the conductor pattern (am) and the external electrode 22 is expressed as d1*c*×(5−m)/4≤d(m)≤d1*c*. In order to satisfy this relationship, in a case of a distance d(2) between the conductor pattern in the second turn as counted from the external electrode 21 and the external electrode 22, since m=2, an inequality d1*c*×¾≤d(2)≤d1*c*is established. In a case where the distance d(2) between the conductor pattern in the second turn and the external electrode 22 is equal to the spacing d3*c* between the conductor pattern C13 and the external electrode 22, an inequality d1*c*×¾≤d3*c*≤d1*c* is established. Similarly, in a case of a distance d(3) between the conductor pattern in the third turn as counted from the external electrode 21 and the external electrode 22, since m=3, an inequality d1*c*×½≤d(3)≤d1*c* is established. In a case where the distance d(3) between the conductor pattern in the third turn and the external electrode 22 is equal to the spacing d5*c* between the conductor pattern C15 and the external electrode 22, an inequality d1*c*×½≤d5*c*≤d1*c* is established. Similarly, in a case of a distance d(4) between the conductor pattern in the fourth turn as counted from the external electrode 21 and the external electrode 22, since m=4, an inequality d1*c*×¼≤d(4)≤d1*c* is established. In a case where the distance d(4) between the conductor pattern in the fourth turn and the external electrode 22 is equal to the spacing d6*c* between the conductor pattern C16 and the external electrode 22, an inequality d1*c*×¼≤d6*c*≤d1*c* is established. It is, however, also required to satisfy the condition that when m has a certain value, d(m) and d (1) have different values from each other, and thus d(1) (=d1*c*) has a value different from at least one of respective values of d(2), d(3), and d(4).

In this electric current path linking the external electrode 21 to the external electrode 22, since the conductor pattern (a1) is arranged more closely to the external electrode 21 than the conductor pattern (am), when a voltage is applied between the external electrode 21 and the external electrode 22, a potential difference between the conductor pattern (a1) and the external electrode 22 is larger than a potential difference between the conductor pattern (am) and the external electrode 22. According to the above-described embodiment, since the relationship d(1)×(N−m+1)/N≤d(m)≤d(1) (where when m has a certain value, d(m) and d(1) have different values from each other) is satisfied, the conductor pattern (a1) having the largest potential difference from the external electrode 22 is arranged farthest from the external electrode 22. As described above, a distance d(1) between the conductor pattern (a1) and the external electrode 22 is set so that an insulation property between the conductor pattern (a1) and the external electrode 22 is ensured. As thus described, the distance between the conductor pattern (a1) having a large potential difference from the external electrode 22 and the external electrode 22 is set to be large, and thus an insulation property between the conductor pattern (a1) and the external electrode 22 is ensured. Even though a distance between the conductor pattern (am) and the external electrode 22 is equal to or less than a value of d(1), an insulation property between the conductor pattern (am) and the external electrode 22 can be ensured.

The coil conductor 25 in one embodiment of the present invention is configured so that, where a maximum number of turns of the coil conductor 25 is N, a distance D(n) between the conductor pattern (bn) in the n-th turn as counted from the external electrode 22 and the external electrode 21 satisfies a relationship D(1)×(N−m+1)/N≤D(n)≤D(1) (where when n has a certain value, D(n) and D(1) have different values from each other) (where 2≤n).

As described above, in the embodiment shown, the conductor pattern (b1) in the first turn as counted from the external electrode 22 has the entire conductor pattern C16 and a portion of the conductor pattern C15 extending 90° counterclockwise from the connection point with the via V5. In the embodiment shown, at least part of the conductor pattern C16 is arranged more closely to the external electrode 21 than the conductor pattern C15. Therefore, as a distance between the conductor pattern (b1) in the first turn and the external electrode 21, the smallest among the spacings d6*a*, d6*b*1, d6*d*2, and d6*f* between the various portions of the conductor pattern C16 and the external electrode 21 is used. The distance between the conductor pattern (b) and the external electrode 21 is set so that an insulation property between the conductor pattern (b1) and the external electrode 21 is ensured.

In one embodiment of the present invention, as mentioned above, the conductor pattern C16 is formed and disposed so that the spacing d6*a* is the smallest among the spacings d6*a*, d6*b*1, d6*d*2, and d6*f*. In this case, the distance between the conductor pattern (b1) in the first turn and the external electrode 21 is equal to the spacing d6*a* between the second portion C16*a* and the external electrode 21.

A distance between each of the conductor patterns in the second and subsequent turns and the external electrode 21 is also defined similarly to the distance between the conductor pattern (b1) in the first turn and the external electrode 21. That is, a distance between the conductor pattern (bn) in the n-th turn as counted from the external electrode 22 and the external electrode 21 refers to the smallest among the spacings between the conductor pattern (bn) and the external electrode 21. The distance between the conductor pattern (bn) and the external electrode 21 is set so that an insulation property between the conductor pattern (bn) and the external electrode 21 is ensured.

In another embodiment of the present invention, the conductor pattern C16 can be formed and disposed so that, among the spacings d6*a*, d6*b*1, d6*d*2, and d6*f*, any one of them other than the spacing d6*a* is the smallest. For example, when the spacing d6*b*1 is the smallest among the spacings d6*a*, d6*b*1, d6*d*2, and d6*f*, the distance between the conductor pattern (b1) and the external electrode 21 corresponds to the spacing d6*b*1. When the spacing d6*d*2 is the smallest among them, the distance between the conductor pattern (b1) and the external electrode 21 corresponds to the spacing d6*d*2. When the spacing d6*f* is the smallest among them, the distance between the conductor pattern (b1) and the external electrode 21 corresponds to the spacing d6*f*.

In the embodiment shown, N=4 and D(1)=d6*a*, and thus a distance D(n) between the conductor pattern (bn) and the external electrode 21 is expressed as d6*a*×(5−n)/4≤D(n)≤d6*a*. In order to satisfy this relationship, in a case of a distance D(2) between the conductor pattern in the second turn as counted from the external electrode 22 and the external electrode 21, since n=2, an inequality d6*a*×¾≤D(2)≤d6*a* is established. In a case where the distance D(2) between the conductor pattern in the second turn and the external electrode 21 is equal to the spacing d4*a* between the conductor pattern C14 and the external electrode 21, an inequality d6*a*×¾≤d4*a*≤d6*a* is established. Similarly, in a case of a distance D(3) between the conductor pattern in the third turn as counted from the external electrode 22 and the external electrode 21, since n=3, an inequality d6*a*×½≤D(3)≤d6*a* is established. In a case where the distance D(3) between the conductor pattern in the third turn and the external electrode 21 is equal to the spacing d2*a* between the conductor pattern C12 and the external electrode 21, an inequality d6*a*×½≤d2*a*≤d1 is established. Similarly, in a case of a distance D(4) between the conductor pattern in the fourth turn as counted from the external electrode 22 and the external electrode 21, since n=4, an inequality d6*a*×¼≤D(4)≤d6*a* is established. In a case where the distance D(4) between the conductor pattern in the fourth turn and the external electrode 21 is equal to the spacing d1*a* between the conductor pattern C11 and the external electrode 21, an inequality d6*a*×¼d1*a*≤d6*a* is established. It is also required to satisfy the condition that when n has a certain value, D(n) and D(1) have different values from each other, and thus D(1) (=d6*a*) has a value different from at least one of respective values of D(2), D(3), and D(4).

According to the above-described embodiment, since the relationship D(1) ×(N−m+1)/N≤D(n)≤D(1) (where when n has a certain value, D(n) and D(1) have different values from each other) is satisfied, the conductor pattern (b1) having the largest potential difference from the external electrode 21 is arranged farthest from the external electrode 21. As thus described, the distance between the conductor pattern (b1) having a large potential difference from the external electrode 21 and the external electrode 21 is set to be large, and thus an insulation property between the conductor pattern (b1) and the external electrode 21 is ensured. Even though a distance between the conductor pattern (bn) other than the conductor pattern (b1) and the external electrode 21 is equal to or less than a value of D(1), an insulation property between the conductor pattern (bn) and the external electrode 21 can be ensured.

In one embodiment of the present invention, the coil conductor 25 is configured so that the distance d(m) between the conductor pattern (am) in the m-th turn as counted from the external electrode 21 and the external electrode 22 is equal to or more than a distance d(m+1) between the conductor pattern (a(m+1)) in an (m+1)-th turn as counted from the external electrode 21 and the external electrode 22 (where when N is a maximum number of turns, m is any integer satisfying 1≤m≤N−1), and when m has a certain value, d(m) and d(m+1) have different values from each other.

In one embodiment of the present invention, the coil conductor 25 is configured so that the distance D(n) between the conductor pattern (bn) in the n-th turn as counted from the external electrode 22 and the external electrode 21 is equal to or more than a distance D(n+1) between the conductor pattern (b(n+1)) in an (n+1)-th turn as counted from the external electrode 22 and the external electrode 21 (where n is any integer satisfying 1≤n≤N−1), and when n has a certain value, D(n) and D(n+1) have different values from each other.

In the embodiment shown, the spacing d1*c* between the conductor pattern (a1) in the first turn as counted from the external electrode 21 and the external electrode 22 is larger than the spacing d3*c* between the conductor pattern (a2) in the second turn as counted from the external electrode 21 and the external electrode 22. Furthermore, the spacing d3*c* is larger than the spacing d5*c* between a conductor pattern (a3) in the third turn as counted from the external electrode 21 and the external electrode 22. Furthermore, the spacing d5*c* is larger than the spacing d6*c* between a conductor pattern (a4) in the fourth turn as counted from the external electrode 21 and the external electrode 22. As thus described, in the embodiment shown, a relationship d6*c*<d5*c*<d3*c*<d1*c* is established. A magnitude relationship among the spacings between the conductor pattern in the m-th turn as counted from the external electrode 21 and the external electrode 22 is not limited to the relationship d6*c*<d5*c*<d3*c*<d1*c*. Any two or three values selected from among respective values of the spacings d1*c*, d3*c*, d5*c*, and d6*c* may be equal to each other. For example, in a case where the respective values of the spacings d3*c* and d5*c*, which are two values among the respective values of the spacings, are equal to each other, the magnitude relationship between the spacings is expressed as d6*c*<d5*c*=d3*c*<d1*c*. In a case where the respective values of the spacings d1*c* and d3*c*, which are two values among the respective values of the spacings, are equal to each other, the magnitude relationship between the spacings is expressed as d6*c*<d5*c*<d3*c*=d1*c*. In a case where the respective values of the spacings d3*c*, d5*c*, and d6*c*, which are three values among the respective values of the spacings, are equal to each other, the magnitude relationship between the spacings is expressed as d6*c*=d5*c*=d3*c*<d1*c*. The magnitude relationship among the spacings based on any other combination of equal spacings can be considered in a similar manner.

A similar relationship applies to a case where the number of turns is counted from the external electrode 22. Specifically, in the embodiment shown, the spacing d6*a* between the conductor pattern (b1) in the first turn as counted from the external electrode 22 and the external electrode 21 is larger than the spacing d4*a* between a conductor pattern (b2) in the second turn as counted from the external electrode 22 and the external electrode 21. Furthermore, the spacing d4*a* is larger than the spacing d2*a* between a conductor pattern (b3) in the third turn as counted from the external electrode 22 and the external electrode 21. Furthermore, the spacing d2*a* is larger than the spacing d1*a* between a conductor pattern (b4) in the fourth turn as counted from the external electrode 22 and the external electrode 21. As thus described, in the embodiment shown, a relationship d1*a*<d2*a*<d4*a*<d6*a* is established. Any two or three values selected from among respective values of the spacings d1*a*, d2*a*, d4*a*, and d6*a* may be equal to each other. For example, in a case where the respective values of d2*a* and d4*a*, which are two values among the respective values of the spacings, are equal to each other, the magnitude relationship between the spacings is expressed as d1*a*<d2*a*=d4*a*<d6*a*. In a case where the respective values of d6*a* and d4*a*, which are two values among the respective values of the spacings, are equal to each other, the magnitude relationship between the spacings is expressed as d1*a*<d2*a*<d4*a*=d6*a*. In a case where the respective values of d1*a*, d2*a*, and d4*a*, which are three values among the respective values of the spacings, are equal to each other, the magnitude relationship between the spacings is expressed as d1*a*=d2*a*=d4*a*<d6*a*. The magnitude relationship among the spacings based on any other combination of equal spacings can be considered in a similar manner.

According to the above-described embodiment, a relationship is satisfied in which the distance d(1) (d1*c* in the embodiment shown) between the conductor pattern (a1) in the first turn as counted from the external electrode 21 and the external electrode 22 is larger than any of values of the distance d(m) between the conductor pattern (am) in the m-th turn as counted from the external electrode 21 and the external electrode 22, and thus the conductor pattern (a1) having the largest potential difference from the external electrode 22 is arranged farthest from the external electrode 22. As thus described, the distance between the conductor pattern (a1) having a large potential difference from the external electrode 22 and the external electrode 22 is set to be large, and thus an insulation property between the conductor pattern (a1) and the external electrode 22 is ensured. In the coil conductor 25, a potential difference between the conductor pattern (am) other than the conductor pattern (a1) and the external electrode 22 is smaller than a potential difference between the conductor pattern (a1) and the external electrode 22, and thus even though the distance d(m) is equal to or less than a value of d(1), an insulation property between the conductor pattern (a1) and the external electrode 22 can be ensured.

Similarly, a relationship is satisfied in which the distance D(1) (d6*a* in the embodiment shown) between the conductor pattern (b1) in the first turn as counted from the external electrode 22 and the external electrode 21 is larger than any of values of the distance D(n) between the conductor pattern (bn) in the n-th turn as counted from the external electrode 22 and the external electrode 21, and thus the conductor pattern (b1) having the largest potential difference from the external electrode 21 is arranged farthest from the external electrode 21. As thus described, the distance between the conductor pattern (b1) having a large potential difference from the external electrode 21 and the external electrode 21 is set to be large, and thus an insulation property between the conductor pattern (b1) and the external electrode 21 is ensured. In the coil conductor 25, a potential difference between the conductor pattern (bn) other than the conductor pattern (b1) and the external electrode 21 is smaller than a potential difference between the conductor pattern (b1) and the external electrode 21, and thus even though the distance D(n) is equal to or less than a value of D(1), an insulation property between the conductor pattern (b1) and the external electrode 21 can be ensured.

As mentioned above, in the embodiment shown, when viewed from the direction of the coil axis A, an inner periphery of each of the conductor patterns C11 to C16 extends along at least part of the closed loop B. Thus, as shown in FIG. 4, a plane C extending through the respective inner peripheral surfaces C11*g* to C16*g* of the conductor patterns C11 to C16 extends parallel to the coil axis A. Therefore, a magnetic flux passing through a core defined by the respective inner peripheral surfaces C11*g* to C16*g* of the conductor patterns C11 to C16 is directed parallel to the coil axis A. This can prevent a degradation in inductance due to a direction of a magnetic flux passing through the core being inclined with respect to the coil axis A.

As shown in FIG. 3*a*, on the closed loop B, there are a first position P1 closest to the first external electrode 21 and a second position P2 closest to the second external electrode 22. In the embodiment shown, an outline of the insulating layer 11 and the closed loop B both have a rectangular shape, and thus the first position P1 is any position on the side Ba of the closed loop B, and the second position P2 is any position on the side Bc of the closed loop B. Arrangements of the first position P1 and the second position P2 are set as appropriate depending on a shape of the laminate 10 and a shape of the closed loop B.

Figure 5A:
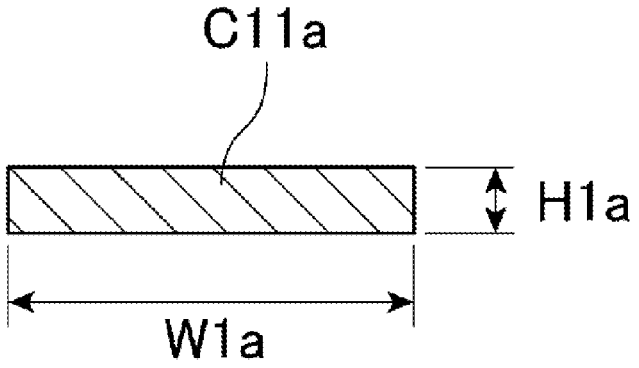
FIG. 5*a* is a sectional view of a first portion C11*a* of a conductor pattern C11 along a line II-II in FIG. 3*a*.
Figure 5B:
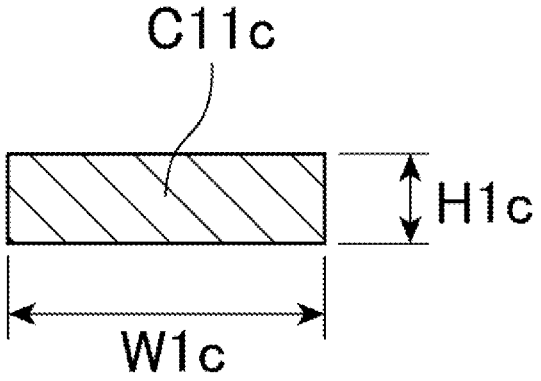
FIG. 5*b* is a sectional view of a third portion C11*c* of the conductor pattern C11 along a line III-III in FIG. 3*a*.

FIG. 5*a* is a sectional view of the conductor pattern C11 cut in a direction perpendicular to an extending direction of the conductor pattern C11 so as to extend through the first position P1. Specifically, FIG. 5*a* is a sectional view of the first portion C11*a* of the conductor pattern C11 along a line II-II in FIG. 3*a*. FIG. 5*b* is a sectional view of the conductor pattern C11 cut in the direction perpendicular to the extending direction of the conductor pattern C11 so as to extend through the second position P2. Specifically, FIG. 5*b* is a sectional view of the third portion C11*c* of the conductor pattern C11 along a line III-III in FIG. 3*a*.

As described above, the coil conductor 25 is formed so that the distance between the conductor pattern (a1) in the first turn as counted from the external electrode 21 and the external electrode 22 is larger than a distance between each of the other conductor patterns (the conductor pattern (am)) and the external electrode 22. Such a relationship is achieved by, for example, a technique in which, at the second position P2, with an inner periphery of the conductor pattern (a1) secured on the closed loop B, the dimension W1*c* of the conductor pattern (a1) in a width direction is reduced. In this case, at the second position P2, a direct current resistance (Rdc) of the conductor pattern C11 is disadvantageously increased. As a solution to this, the conductor pattern C11 is formed so that a thickness thereof at the second position P2 is greater than that at any other portion thereof, and thus it is possible to prevent an increase in direct current resistance (Rdc) of the conductor pattern C11 at the second position P2. For example, the conductor pattern C11 could be formed so that a cross-sectional area thereof at the second position P2 is equal to that at the first position P1. Based on dimensions shown in FIG. 5*a*, the cross-sectional area of the conductor pattern C11 at the first position P1 is a product of W1*a* and H1*a*, and based on dimensions shown in FIG. 5*b*, the cross-sectional area of the conductor pattern C11 at the second position P2 is a product of W1*c* and H1*c*. The conductor pattern C11 is formed so that the product of W1*a* and H1*a* is equal to the product of W1*c* and B1*c*. Similarly, the conductor pattern C16 may be formed so that a cross-sectional area thereof at the second position P2 is equal to that at the first position P1.

Next, a description is given of an example of a production method of the coil component 1. First, magnetic sheets used to form the insulating layers 11 to 16, the insulating layers 18*a* to 18*d*, and the insulating layers 19*a* to 19*d* are prepared. Specifically, a solvent is added to a resin material to produce slurry. The resin material is, for example, a resin (a resin having an excellent insulation property such as, for example, a polyvinyl butyral (PVB) resin or an epoxy resin) in which filler particles are dispersed. The slurry is applied to a surface of a base film made of plastic and then dried, and the dried slurry is cut to a predetermined size. The magnetic sheets are obtained in this manner.

Next, at predetermined positions on the magnetic sheets used to form the insulating layers 11 to 15, through-holes are formed so as to extend through these insulating layers in the T axis direction, respectively.

Next, by printing such as screen printing, plating, etching, or any other known method, on an upper surface of the magnetic sheet used to form the insulating layer 11, a multitude of conductor patterns corresponding to the conductor pattern C11 and the lead-out conductor 23 are formed from a metal material (for example, Ag), and the metal material is filled into the through hole formed through this magnetic sheet. Similarly, on upper surfaces of the magnetic sheets used to form the insulating layers 12 to 14, a multitude of conductor patterns corresponding to the conductor patterns C12 to C15 are formed, respectively, and the metal material is filled into the through holes formed through these magnetic sheets. Furthermore, on an upper surface of the magnetic sheet used to form the insulating layer 16, a multitude of conductor patterns corresponding to the conductor pattern C16 and the lead-out conductor 24 are formed from a metal material (for example, Ag). A metal thus filled into the through-holes forms the vias V1 to V5.

Next, the magnetic sheets with the conductor patterns corresponding to the conductor patterns C11 to C16 formed thereon are stacked together to obtain an intermediate laminate. These magnetic sheets are stacked together so that the conductor patterns C11 to C16 formed thereon, respectively, are each electrically connected to an adjacent one of the conductor patterns via the vias V1 to V5.

Next, the magnetic sheets used to form the insulating layers 18*a* to 18*d* are stacked together to from a top laminate corresponding to the top cover layer 18, and the magnetic sheets used to form the insulating layers 19*a* to 19*d* are stacked together to form a bottom laminate corresponding to the bottom cover layer 19.

Next, the intermediate laminate formed in the above-described manner is sandwiched from top and bottom between the top laminate and the bottom laminate, and the top laminate and the bottom laminate are bonded to the intermediate laminate by thermal compression to obtain a body laminate. Next, the body laminate is segmented into units of a desired size by using a cutter such as a dicing machine or a laser processing machine to obtain a chip laminate corresponding to the laminate 10. Next, the chip laminate is subjected to degreasing, and the chip laminate thus degreased is heat-treated. Next, a conductor paste is applied to both end portions of the heat-treated chip laminate to form the external electrode 21 and the external electrode 22. Thus, the coil component 1 is obtained.

The dimensions, materials, and arrangements of the various constituent elements described in this specification are not limited to those explicitly described in the embodiments, and the various constituent elements can be modified to have any dimensions, materials, and arrangements within the scope of the present invention. Furthermore, constituent elements not explicitly described in this specification can also be added to the embodiments described, and some of the constituent elements described in the embodiments can also be omitted.

What is claimed is:

1. A laminated coil component, comprising:

a laminate including a plurality of insulating layers stacked together in a lamination direction extending along a coil axis;

a first external electrode provided on a surface of the laminate;

a second external electrode provided on a surface of the laminate; and a coil conductor having a plurality of conductor patterns wound around the coil axis, the coil conductor being provided, in the laminate, between the first external electrode and the second external electrode, wherein among the plurality of conductor patterns, a conductor pattern (al) in a first turn as counted from the first external electrode is connected to the first external electrode, and a conductor pattern (aN) in an N-th turn (where N is any integer equal to or higher than two) as counted from the first external electrode is connected to the second external electrode, when viewed from the direction of the coil axis, an inner periphery of each of the plurality of conductor patterns extends along at least part of a closed loop surrounding the coil axis such that a plane extending through the inner periphery of each of the plurality of conductor patterns extends in parallel with the coil axis, and the coil conductor is configured so that a distance d(m) between the second external electrode and a conductor pattern (am), among the plurality of conductor patterns, in an m-th turn (where m is any integer satisfying $2 \leq m \leq N$) as counted from the first external electrode a relationship $d(1) \times (N-m+1)/N \leq d(m) \leq d(1)$ (where when m has a certain value, d(m) and d(1) have different values from each other).

2. The laminated coil component according to claim 1, wherein the coil conductor is configured so that a distance D(n) between the first external electrode and a conductor pattern (bn), among the plurality of conductor patterns, in an n-th turn (where n is any integer satisfying $2 \leq n \leq N$) as counted from the second external electrode a relationship $D(1) \times (N-m+1)/N \leq D(n) \leq D(1)$ (where when n has a certain value, D(n) and D(1) have different values from each other).

3. The laminated coil component according to claim 1, wherein on the closed loop, there are a first position closest to the first external electrode and a second position closest to the second external electrode, and the conductor pattern (al) is formed so that a cross-sectional area thereof at the first position on the closed loop is equal to that at the second position on the closed loop.

4. The laminated coil component according to claim 1, wherein the coil conductor is connected to the first external electrode via a first lead-out conductor and to the second external electrode via a second lead-out conductor.

5. The laminated coil component according to claim 1, wherein a plane including the inner periphery of each of the plurality of conductor patterns extends parallel to a lamination direction in which the plurality of insulating layers are stacked.

6. A laminated coil component, comprising:

a laminate including a plurality of insulating layers stacked together in a direction of a coil axis;

a first external electrode provided on a surface of the laminate;

a second external electrode provided on a surface of the laminate; and a coil conductor having a plurality of conductor patterns wound around the coil axis, the coil conductor being provided, in the laminate, between the first external electrode and the second external electrode, wherein among the plurality of conductor patterns, a conductor pattern (al) in a first turn as counted from the first external electrode is connected to the first external electrode, and a conductor pattern (aN) in an N-th turn (where N is any integer equal to or higher than two) as counted from the first external electrode is connected to the second external electrode, when viewed from the direction of the coil axis, an inner periphery of each of the plurality of conductor patterns extends along at least part of a closed loop surrounding the coil axis such that a plane extending through the inner periphery of each of the plurality of conductor patterns extends in parallel with the coil axis, and the coil conductor is configured so that a distance d(m) between the second external electrode and a conductor pattern (am), among the plurality of conductor patterns, in an m-th turn as counted from the first external electrode is equal to or more than a distance d(m+1) between a conductor pattern (a(m+1)), among the plurality of conductor patterns, in an (m+1)-th turn as counted from the first external electrode and the second external electrode (where m is any integer satisfying $1 \leq m \leq N-1$), and when m has a certain value, d(m) and d(m+1) have different values from each other.

7. The laminated coil component according to claim 6, wherein the coil conductor is configured so that a distance D(n) between the first external electrode and a conductor pattern (bn), among the plurality of conductor patterns, in an n-th turn as counted from the second external electrode is equal to or more than a distance D(n+1) between a conductor pattern (b(n+1)), among the plurality of conductor patterns, in an (n+1)-th turn as counted from the second external electrode and the first external electrode (where n is any integer satisfying $1 \leq n < N-1$), and when n has a certain value, D(n) and D(n+1) have different values from each other.

8. The laminated coil component according to claim 6, wherein on the closed loop, there are a first position closest to the first external electrode and a second position closest to the second external electrode, and the conductor pattern (al) is formed so that a cross-sectional area thereof at the first position on the closed loop is equal to that at the second position on the closed loop.

9. The laminated coil component according to claim 6, wherein the coil conductor is connected to the first external electrode via a first lead-out conductor and to the second external electrode via a second lead-out conductor.

10. The laminated coil component according to claim 6, wherein a plane including the inner periphery of each of the plurality of conductor patterns extends parallel to a lamination direction in which the plurality of insulating layers are stacked.

* * * * *